US006869908B2

(12) United States Patent
Ueki et al.

(10) Patent No.: US 6,869,908 B2
(45) Date of Patent: Mar. 22, 2005

(54) THERMAL RECORDING MATERIAL

(75) Inventors: Shiki Ueki, Shizuoka-ken (JP); Kazumori Minami, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 51 days.

(21) Appl. No.: 10/321,821

(22) Filed: Dec. 18, 2002

(65) Prior Publication Data

US 2003/0186808 A1 Oct. 2, 2003

(30) Foreign Application Priority Data

Dec. 19, 2001 (JP) ..... 2001-386329

(51) Int. Cl.[7] ..... B41M 5/30
(52) U.S. Cl. ..... 503/209; 503/204; 503/215
(58) Field of Search ..... 503/200, 204, 503/208, 209, 214, 215, 216, 226

(56) References Cited

U.S. PATENT DOCUMENTS 4,895,826 A * 1/1990 Watanabe et al. ..... 503/202
4,918,045 A * 4/1990 Matsuoka et al. ..... 503/213

FOREIGN PATENT DOCUMENTS

| | | |
|---|---|---|
| JP | 62-055191 | 3/1987 |
| JP | 63-265682 | 11/1988 |
| JP | 01-285832 | 11/1989 |

* cited by examiner

*Primary Examiner*—B. Hamilton Hess
(74) *Attorney, Agent, or Firm*—Sughrue Mion, PLLC

(57) ABSTRACT

The invention provides a thermal recording material, which includes at least one recording layer containing an electron donating dye precursor and an electron accepting compound, and additionally, the recording layer includes a polymerizable compound having an ethylenic unsaturated bond.

18 Claims, No Drawings

THERMAL RECORDING MATERIAL

BACKGROUND OF THE INVENTION

1. Field of the Invention

The present invention relates to a thermal recording material, and more particularly, to a thermal recording material utilizing a transparent support adapted for uses such as recording medical images and recording scanning electron microscope (SEM) output.

2. Description of the Related Art

Thermal recording methods have been recently expanding in various fields such as recording methods for facsimiles and printers, and methods for label printing in point of sale (POS) equipment. This expansion is due to features of thermal recording, which possess advantages such as (1) image development being unnecessary; (2) the quality of the recording being similar to plain paper when the support is paper; (3) being easy to handle; (4) high color development density; (5) the recording device being simple and inexpensive; and (6) being free of unwanted noise when recording.

Accordingly, in recent years transparent thermal recording materials have been developed, which can be directly recorded upon using a thermal head, for purposes such as forming multi-colored images, projecting images with an overhead projector (OHP), and, in application to medical imaging, for directly observing images on a light box. JP-A No. 63-265682 describes an example of such a thermal recording material, which includes, on a transparent support such as a polymer film, a recording layer formed by coating and drying a coating liquid in which a substantially colorless color developing component and a colorless color developing component, capable of developing color by reaction with the aforementioned color developing component, are dispersed in a fine particulate state in a binder, or in a state which one of the color developing components is contained in microcapsules while the other is dispersed and emulsified.

Also, JP-A No. 1-285832 proposes a thermal recording material in which an opaque protective layer is laminated on an outermost color developing unit layer on a surface of the support. The proposed thermal recording material has a structure including an opaque protective layer that enables a recording image to be observed as a reflective image from one side. Such a thermal recording material can improve the sharpness of the image.

However, the drawback of these thermal recording materials is that the image tends to be discolored by heat or light, and the storability of the image remains unsatisfactory.

SUMMARY OF THE INVENTION

The present invention has been made in order to overcome the drawback mentioned above and is to provide a thermal recording material excellent in light fastness.

The present invention has been attained in following manners.

A first embodiment of the present invention is a thermal recording material comprising a support and at least one recording layer disposed on the support, wherein the recording layer(s) include(s) an electron donating dye precursor and an electron accepting compound and further include(s) a polymerizable compound having an ethylenic unsaturated bond.

A second embodiment of the present invention is the thermal recording material, according to the first embodiment, wherein the polymerizable compound having the ethylenic unsaturated bond includes two or more ethylenic unsaturated bonds.

A third embodiment of the present invention is the thermal recording material, according to the first embodiment, wherein the polymerizable compound having the ethylenic unsaturated bond includes at least one of compounds represented by Formulas (1) to (7).

(1)

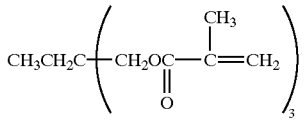

(2)

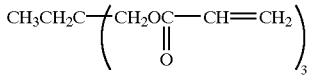

(3)

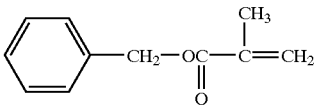

(4)

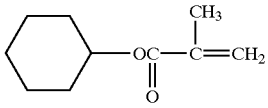

(5)

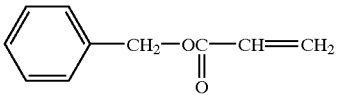

(6)

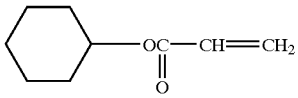

(7)

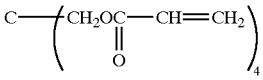

A fourth embodiment of the present invention is the thermal recording material, according to the third embodiment, wherein the polymerizable compound having the ethylenic unsaturated bond includes at least one of compounds represented by the above Formulas (1), (2) and (7).

A fifth embodiment of the present invention is the thermal recording material, according to the first embodiment, wherein the polymerizable compound having the ethylenic unsaturated bond is included in the recording layer in an amount of 25 to 300 parts by mass with respect to 100 parts by mass of the electron donating dye precursor.

A sixth embodiment of the present invention is the thermal recording material, according to the first embodiment, wherein the electron donating dye precursor is included, together with the polymerizable compound having the ethylenic unsaturated bond, in microcapsules.

A seventh embodiment of the present invention is the thermal recording material, according to the sixth embodiment, wherein a wall membrane of the microcapsules includes at least one compound selected from a group consisting of polyurethane resin, polyurea resin, polyurethane-polyurea resin, polyamide resin, polyester resin, polycarbonate resin, aminoaldehyde resin, melamine resin, polystyrene resin, styrene-acrylate copolymer resin, styrene-methacrylate copolymer resin, gelatin, and polyvinyl alcohol.

An eighth embodiment of the present invention is the thermal recording material, according to the sixth embodiment, the microcapsules have a particle size of 0.05 to 1.0 $\mu$m.

A ninth embodiment of the present invention is the thermal recording material, according to the first embodiment, the electron donating dye precursor includes at least one selected from a group consisting of bisphenols and hydroxybenzoic acid esters.

A tenth embodiment of the present invention is the thermal recording material, according to the first embodiment, further comprising at least one recording layer including a diazonium salt compound and a coupler capable of color development by reaction with the diazonium salt compound, thereby being capable of forming a multi-color image.

An eleventh embodiment of the present invention is the thermal recording material, according to the tenth embodiment, wherein the diazonium salt compound is included in microcapsules.

A twelfth embodiment of the present invention is the thermal recording material, according to the tenth embodiment, the recording layer including the diazonium salt compound and the coupler capable of developing a color by reaction with the diazonium salt compound further includes a basic substance.

A thirteenth embodiment of the present invention is the thermal recording material, according to the twelfth embodiment, wherein the base substance includes at least one selected from a group consisting of tertiary amines, piperidines, piperadines, amidines, pyridines, guanidines, and morpholines.

A fourteenth embodiment of the present invention is the thermal recording material, according to the first embodiment, comprising, on a support, at least a first recording layer including an electron donating dye precursor and an electron accepting compound, a second recording layer including a diazonium salt compound having a maximum absorption wavelength within a range of 365±40 nm and a coupler, capable of color development by reaction under heating with the diazonium salt compound, and a third recording layer including a diazonium salt compound having a maximum absorption wavelength within a range of 425±40 nm and a coupler capable of color development by reaction under heating with the diazonium salt compound.

A fifteenth embodiment of the present invention is the thermal recording material, according to the first embodiment, further comprising an intermediate layer, a protective layer and an optical transmittance regulating layer.

A sixteenth embodiment of the present invention is the thermal recording material, according to the fifteenth embodiment, wherein the intermediate layer includes a compound selected from the group consisting of gelatin, phthalated gelatin, polyvinyl alcohol, denatured polyvinyl alcohol, polyvinylpyrrolidine, methylcellulose, sodium polystyrenesulfonate, and a styrene-maleic acid copolymer.

A seventeenth embodiment of the present invention is the thermal recording material, according to the fifteenth embodiment, wherein the protective layer includes at least one selected from the group consisting of polyvinyl alcohol, carboxy-denatured polyvinyl alcohol, a vinyl acetate-acrylamide copolymer, silicon-denatured polyvinyl alcohol, starch, denatured starch, methylcellulose, carboxymethylcellulose, hydroxymethylcellulose, a gelatin, gum Arabic, casein, a styrene-maleic acid copolymer hydrolyzate, a styrene-maleic acid copolymer half ester hydrolyzate, an isobutane-maleic anhydride copolymer hydrolyzate, a polyacrylamide derivative, polyvinylpyrrolidone, sodium polystylenesulfonate, sodium alginate, styrene-butadiene rubber latex, acrylonitrile-butadiene rubber latex, methyl acrylate-butadiene rubber latex, and vinyl acetate emulsion.

An eighteenth embodiment of the present invention is the thermal recording material, according to the fifteenth embodiment, wherein a coating amount of the protective layer is within a range of 0.2 to 5 g/m$^2$ in a dry coating amount.

DESCRIPTION OF THE PREFERRED EMBODIMENTS

The thermal recording material of the present invention includes, on a support, at least a recording layer containing an electron donating dye precursor, an electron accepting compound and a polymerizable compound having an ethylenic unsaturated bond, and may further include an intermediate layer, an optical transmittance regulating layer, a protective layer or the like. At first there will be given an explanation on the recording layer.

(Recording Layer)

The recording layer in the invention contains, together with an electron donating dye precursor and an electron accepting compound, a polymerizable compound having an ethylenic unsaturated bond. The electron donating dye precursor is preferably included in microcapsules together with the polymerizable compound having the ethylenic unsaturated bond.

In the following, there will be shown specific examples of the polymerizable compound having the ethylenic unsaturated bond in the invention, but such polymerizable compound having the ethylenic unsaturated bond in the invention is not limited to such examples:

(1)

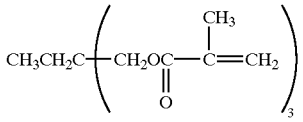

(2)

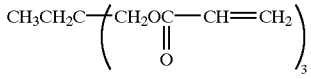

(3)

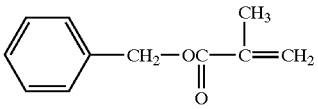

(4)

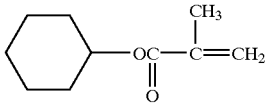

(5)

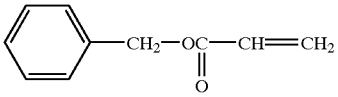

(6)

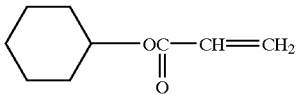

(7)

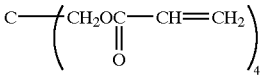

The polymerizable compound having the ethylenic unsaturated bond in the invention is preferably a compound having a plurality (two or more) of the ethylenic unsaturated bonds. More specifically, among the foregoing examples, the compounds (1), (2) and (7) are preferred.

The above-described polymerizable compound having the ethylenic unsaturated bond is added, in preparing a coating liquid for the recording layer to be explained later, preferably in an amount of 25 to 300 parts by mass, more preferably 50 to 150 parts by mass, with respect to 100 parts by mass of the electron donating dye precursor.

The electron donating dye precursor and the electron accepting compound to be used in the invention are detailedly described for example in JP-A Nos. 6-328860, 7-290826, 7-314904, 8-324116, 3-37727, 9-31345, 9-111136, 9-118073, and 11-157221. Specific examples are shown in the following but such examples are not restrictive.

(Specific Examples of Electron Donating Dye Precursor)

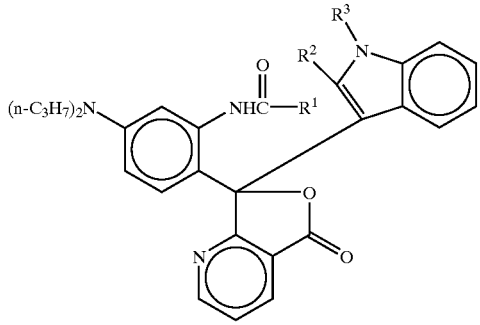

| | $R^1$ | $R^2$ | $R^3$ |
|---|---|---|---|
| i-1 | $—CH_3$ | $—CH_3$ | $—C_2H_5$ |
| i-2 | $—C_2H_5$ | $—CH_3$ | $—C_2H_5$ |
| i-3 | $—CH(CH_3)_2$ | $—CH_3$ | $—C_2H_5$ |
| i-4 | $—C(CH_3)_3$ | $—CH_3$ | $—C_2H_5$ |
| i-5 | 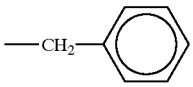 | $—CH_3$ | $—C_2H_5$ |
| i-6 | 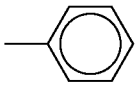 | $—CH_3$ | $—C_2H_5$ |
| i-7 | $—CH_2OCH_3$ | $—CH_3$ | $—C_2H_5$ |
| i-8 | $—CH_2Cl$ | $—CH_3$ | $—C_2H_5$ |
| i-9 | $—CCl_3$ | $—CH_3$ | $—C_2H_5$ |
| i-10 | $—CF_3$ | $—CH_3$ | $—C_2H_5$ |
| i-11 | 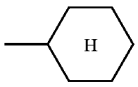 | $—CH_3$ | $—C_2H_5$ |
| i-12 | 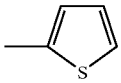 | $—CH_3$ | $—C_2H_5$ |
| i-13 | $—C_3H_7(n)$ | $—CH_3$ | $—C_2H_5$ |
| i-14 | $—CH_3$ | $—CH_3$ | $—C_4H_9(n)$ |
| i-15 | $—CH_3$ | $—CH_3$ | $—C_8H_{17}(n)$ |
| i-16 | $—CH(CH_3)_2$ | $—CH_3$ | $—C_4H_9(n)$ |
| i-17 | 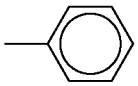 | $—CH_3$ | $—C_5H_{11}(n)$ |
| i-18 | $—CH_2OCH_3$ | $—CH_3$ | $—C_8H_{17}(n)$ |
| i-19 | $—CH_3$ | $—CH_3$ | 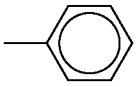 |

-continued
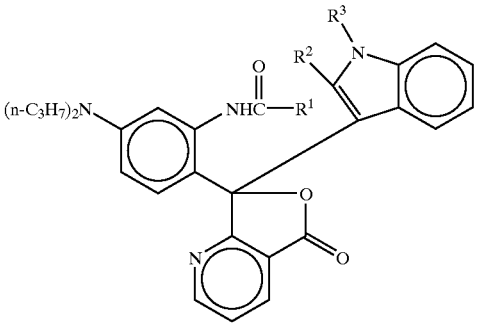
| | $R^1$ | $R^2$ | $R^3$ |
|---|---|---|---|
| i-20 | 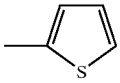 | —$CH_3$ | —$C_6H_{13}$(n) |
| i-21 | —$CH_3$ | 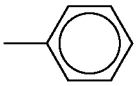 | —$C_2H_5$ |
| i-22 | —$CH_3$ | 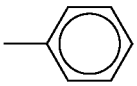 | —$C_8H_{17}$(n) |
| ia-1 | —$C_5H_{11}$(n) | —$CH_3$ | —$C_2H_5$ |
| ia-2 | —$C_7H_{15}$(n) | —$CH_3$ | —$C_2H_5$ |
| ia-3 | —$C_{17}H_{35}$(n) | —$CH_3$ | —$C_2H_5$ |
| ia-4 | 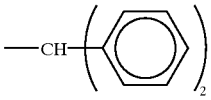 | —$CH_3$ | —$C_2H_5$ |
| ia-5 | 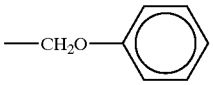 | —$CH_3$ | —$C_2H_5$ |
| ia-6 | 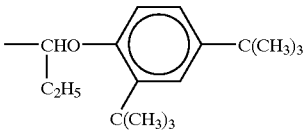 | —$CH_3$ | —$C_2H_5$ |
| ia-7 | —$CH_3$ | —$CH_3$ | —$C_5H_{11}$(n) |
| ia-8 | —$CH_3$ | —$CH_3$ | —$CH(CH_3)_2$ |
| ia-9 | —$C_3H_7$(n) | —$CH_3$ | —$C_8H_{17}$(n) |
| ia-10 | —$C_4H_9$(n) | —$CH_3$ | —$C_8H_{17}$(n) |
| ia-11 | —$CH(CH_3)_2$ | —$CH_3$ | —$C_8H_{17}$(n) |
| ia-12 | —$C_3H_7$(t) | —$CH_3$ | —$C_8H_{17}$(n) |
| ia-13 | —$C_4H_9$(t) | —$CH_3$ | —$C_8H_{17}$(n) |
| ia-14 | 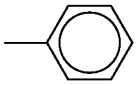 | —$CH_3$ | —$C_8H_{17}$(n) |
| ia-15 | 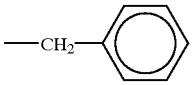 | —$CH_3$ | —$C_8H_{17}$(n) |
| ia-16 | 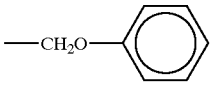 | —$CH_3$ | —$C_8H_{17}$(n) |

-continued
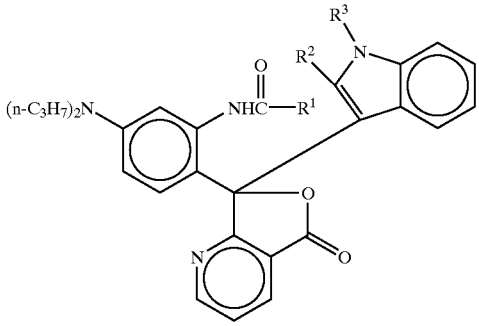
| | $R^1$ | $R^2$ | $R^3$ |
|---|---|---|---|
| ia-17 | —$C_3H_7$(n) | —$CH_3$ | 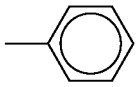 |
| ia-18 | —$CH_3$ | —$CH_3$ | 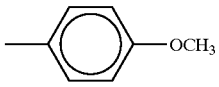 |
| i-23 | 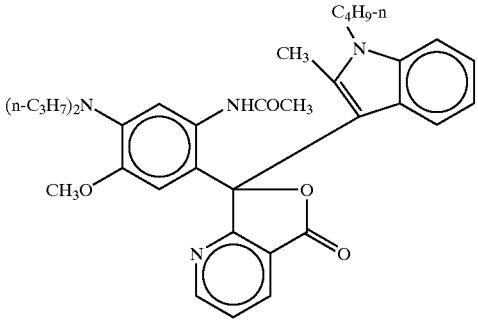 | | |
| i-24 | 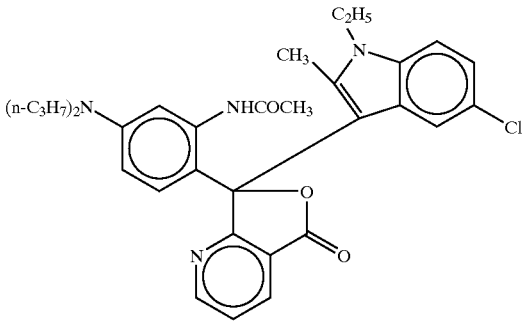 | | |
| i-25 | 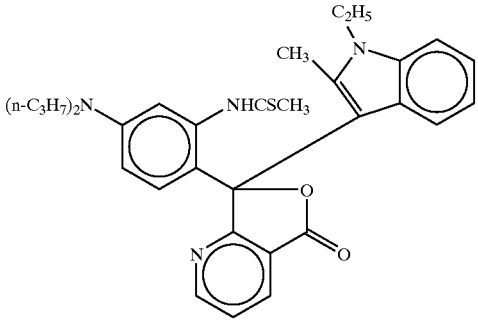 | | |

-continued

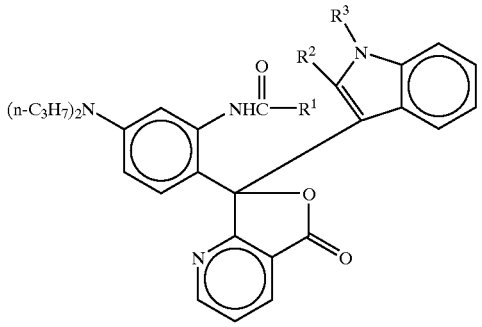

| | $R^1$ | $R^2$ | $R^3$ |
|---|---|---|---|
| i-26 | 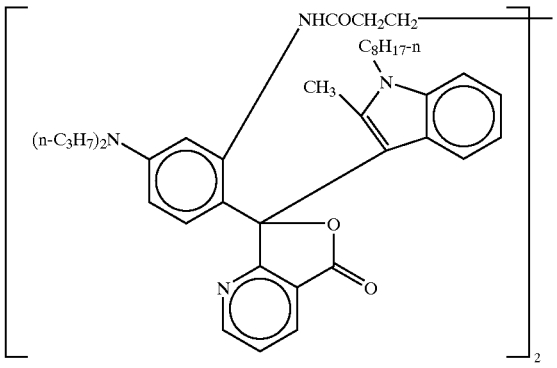 | | |

(Specific Examples of Electron Accepting Compound)

The electron accepting compound can be for example a phenol derivative, a salicylic acid derivative or a hydroxybenzoic acid ester. Particularly preferred is a bisphenol or a hydroxybenzoic acid ester. A part of examples thereof includes 2,2-bis(p-hydroxyphenyl)propane (namely bisphenol-A), 4,4'-(p-phenylenediisopropylidene)diphenol (namely bisphenol-P), 2,2-bis(p-hydroxyphenyl)pentane, 2,2-bis(p-hydroxyphenyl)ethane, 2,2-bis(p-hydroxyphenyl)butane, 2,2-bis(4'-hydroxy-3',5'-dichlorophenyl)propane, 1,1-(p-hydroxyphenyl)cyclohexane, 1,1-(p-hydroxyphenyl)propane, 1,1-(p-hydroxyphenyl)pentane, 1,1-(p-hydroxyphenyl)-2-ethylhexane, 3,5-di(α-methylbenzyl)salicylic acid and a polyvalent metal salt thereof, 3,5-di(tert-butyl)salicylic acid and a polyvalent metal salt thereof, 3-α,α-dimethylbenzyl salicylic acid and a polyvalent metal salt thereof, butyl p-hydroxybenzoate, benzyl p-hydroxybenzoate, 2-ethylhexyl p-hydroxybenzoate, p-phenylphenol and p-cumylphenol.

The thermal recording material of the invention preferably includes, in addition to the recording layer including the electron donating dye precursor, the electron accepting compound and the polymerizable compound having the ethylenic unsaturated bond mentioned in the foregoing, at least a recording layer including a diazonium salt compound and a coupler capable of generating a color by reacting with the diazonium salt compound.

The recording layer including the diazonium salt compound and the coupler capable of generating a color by reacting with the diazonium salt compound utilizes a reaction between the diazonium salt compound and the coupler, and may further contain a basic substance accelerating the reaction of the diazonium salt compound and the coupler.

Such diazonium salt compound, coupler and basic substance can be those already known in the related art, such as those described in detail for example in JP-B Nos. 4-75147, 6-55546 and 6-79867 and JP-A Nos. 4-201483, 60-49991, 60-242094, 61-5983, 63-87125, 4-59287, 5-185717, 7-88356, 7-96671, 8-324129, 9-38389, 5-185736, 5-8544, 59-190866, 62-55190, 60-6493, 60-259492, 63-318546, 4-65291, 5-185736, 5-204089, 8-310133, 8-324129, 9-156229 and 9-175017, but the present invention is not limited to such examples.

In the following, there will be shown specific examples of the diazonium salt compound.

(A-1)

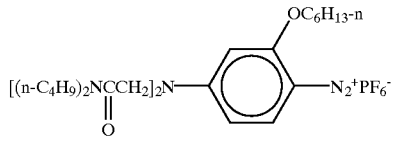

(A-2)

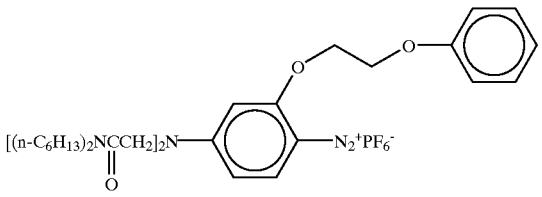

-continued
(A-3)
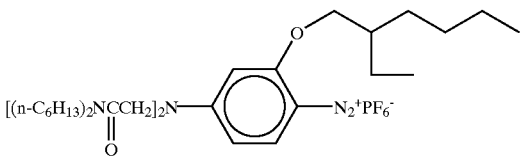
(A-4)
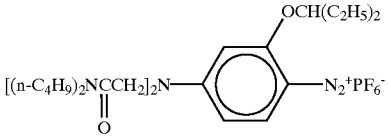
(A-5)
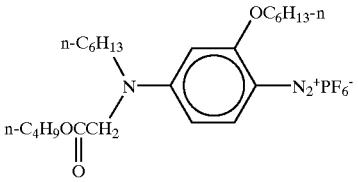
(A-6)
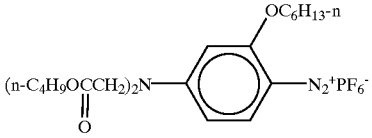
(A-7)
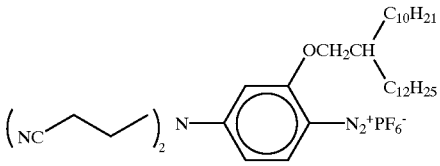
(A-8)
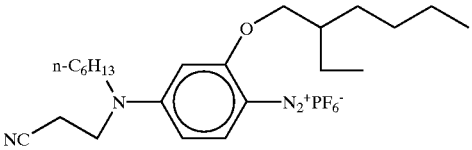
(A-9)
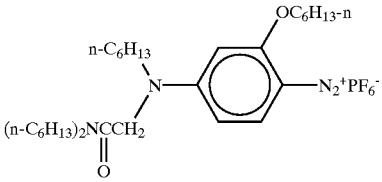
(A-10)
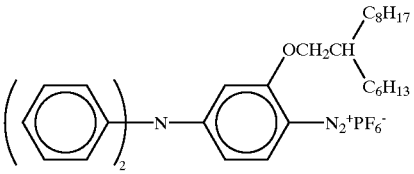
(A-11)
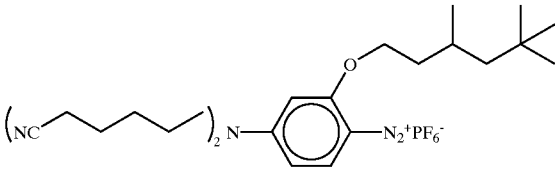
-continued
(A-12)
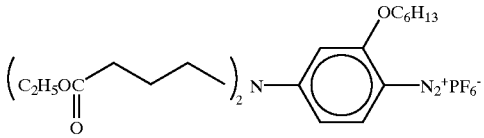
(A-13)
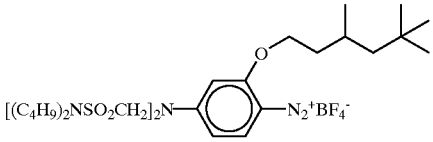
(A-14)
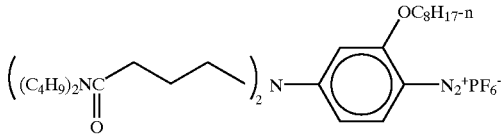
(A-15)
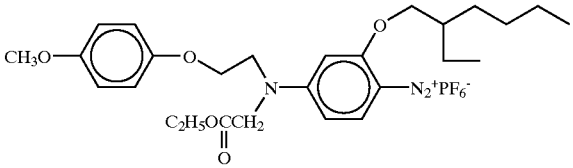
(A-16)
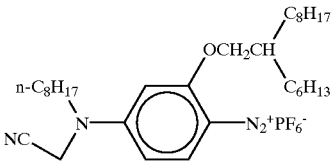
(A-17)
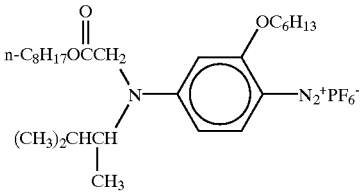
(A-18)
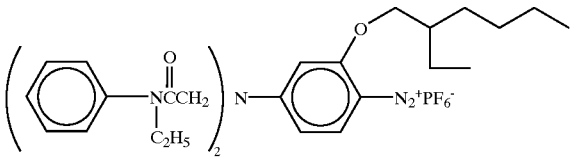
(A-19)
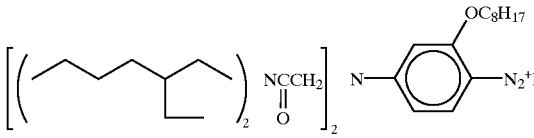
(A-20)
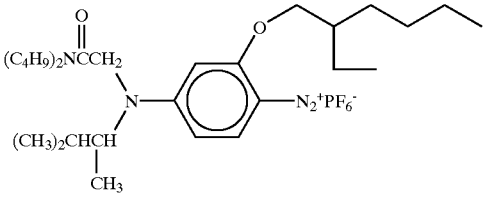

-continued
(A-21)
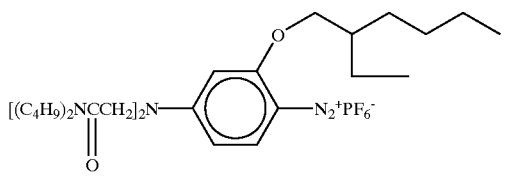
(A-22)
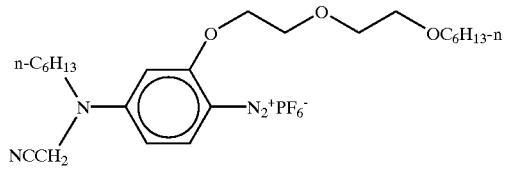
(A-23)
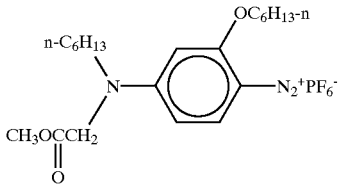
(A)
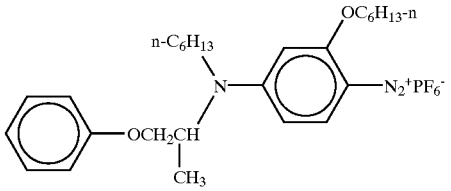
(B)
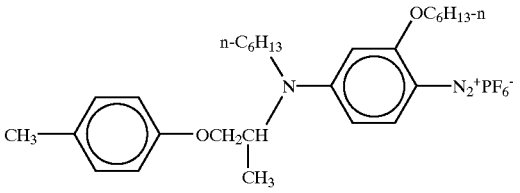
(C)
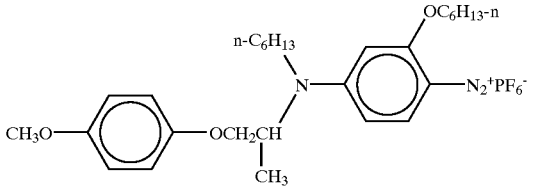
(D)
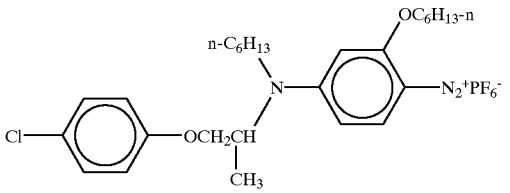
(E)
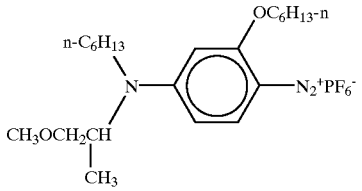
-continued
(F)
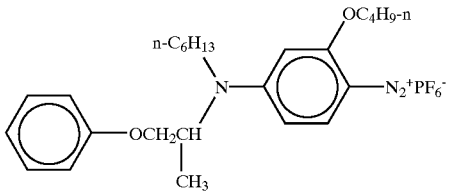
(G)
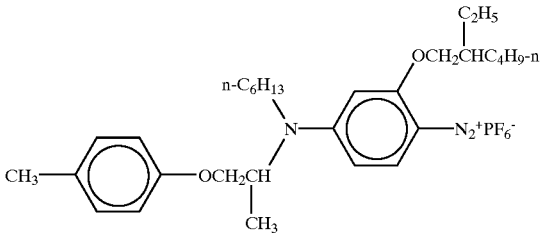
(H)
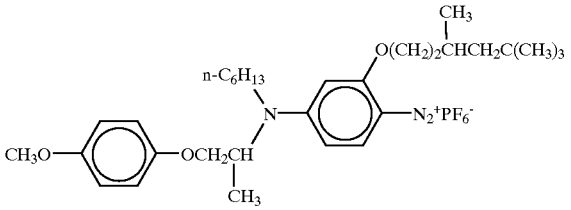
(I)
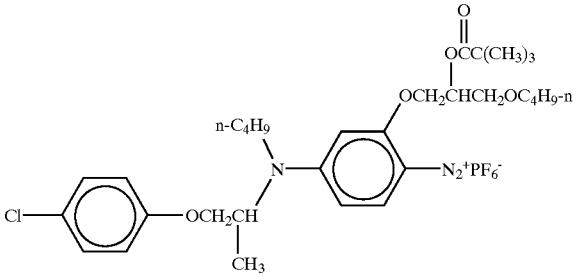
(J)
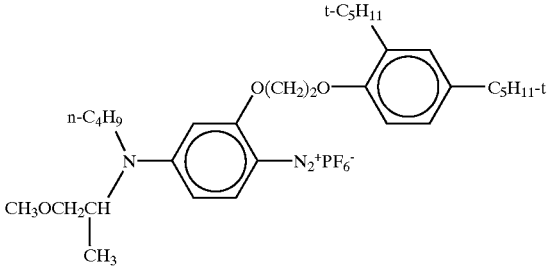
(K)
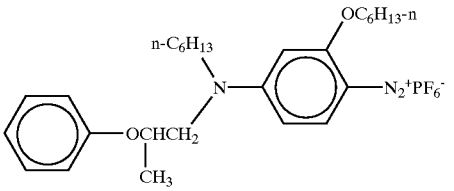

-continued
(L)
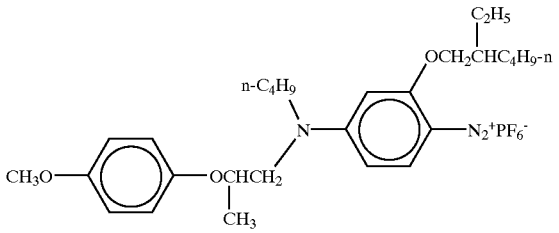
(M)
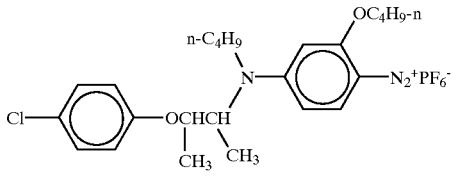
(N)
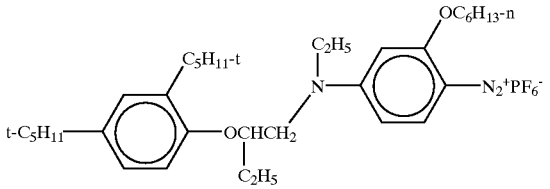
(O)
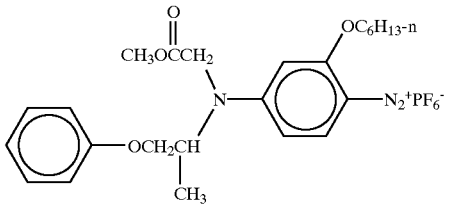
(P)
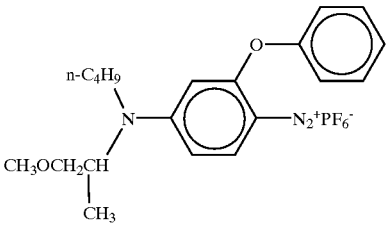
(Q)
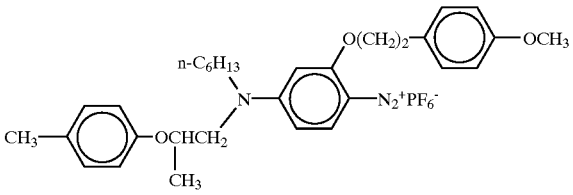
(R)
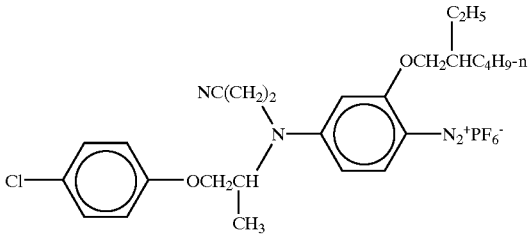
-continued
(S)
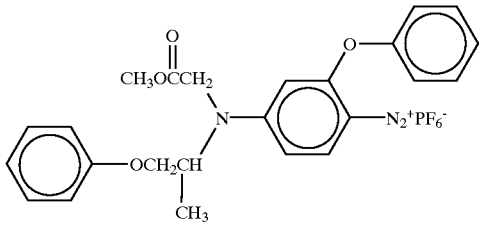
(T)
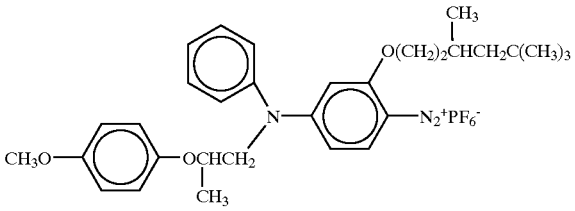
(U)
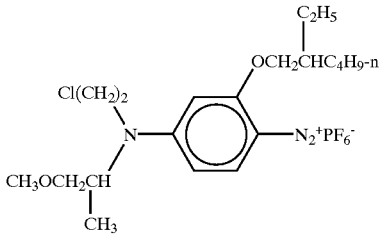
(I-1)
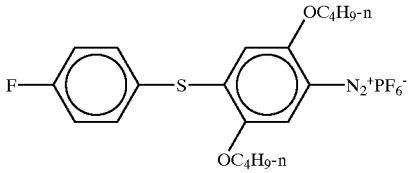
(I-2)
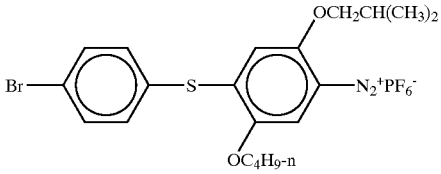
(I-3)
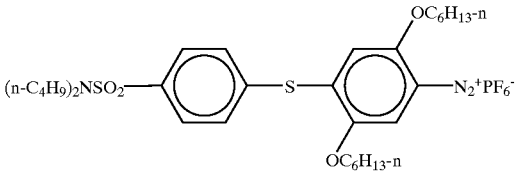
(I-4)
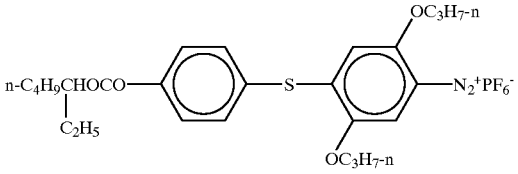

-continued
(I-5)
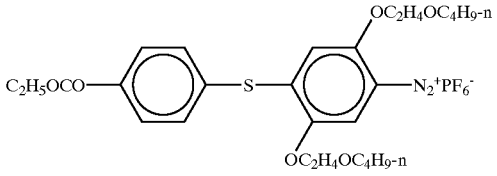
(I-6)
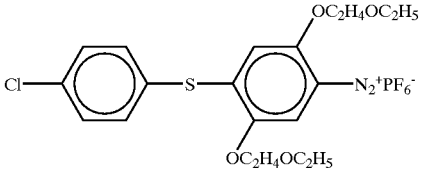
(I-7)
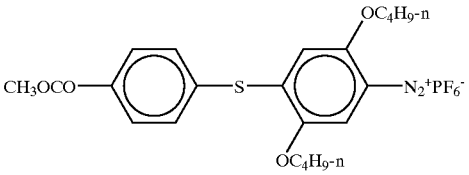
(I-8)
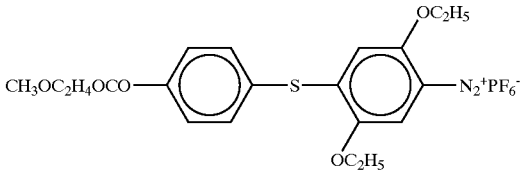
(I-9)
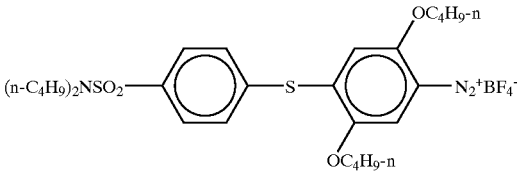
(III-1)
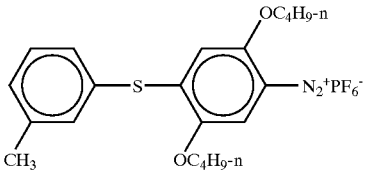
(III-2)
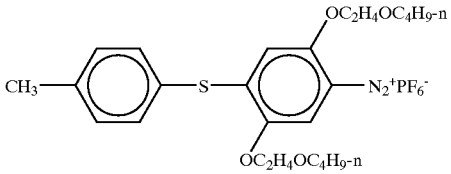
(III-3)
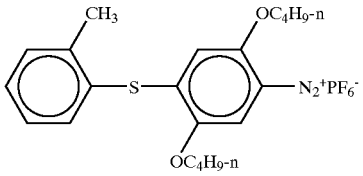
-continued
(III-4)
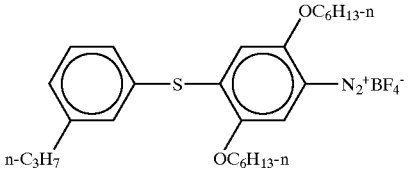
(IV-1)
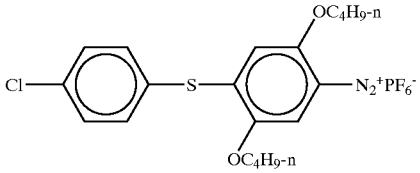
(IV-2)
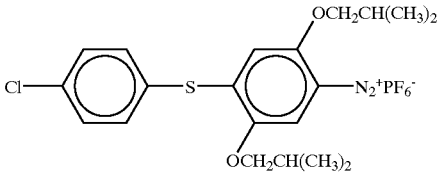
(IV-3)
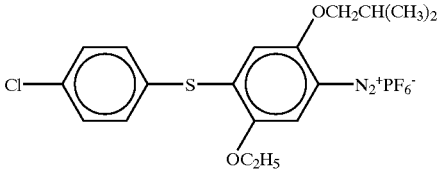
(IV-4)
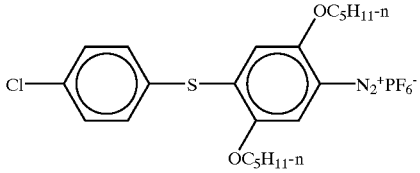
(IV-5)
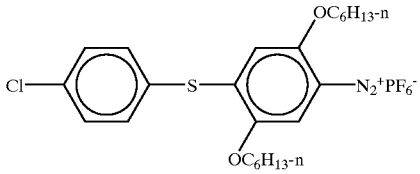
(IV-6)
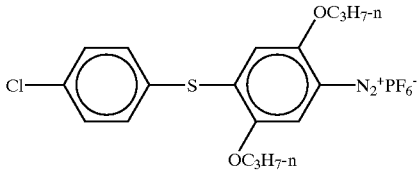
(V-1)
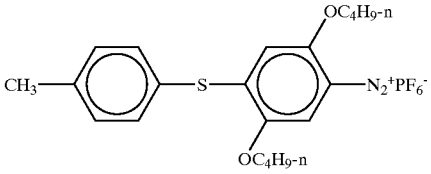

-continued
(V-2)
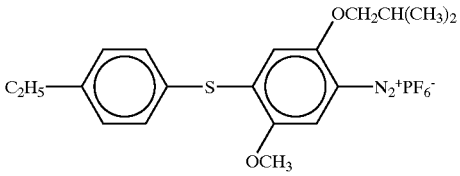
(V-3)
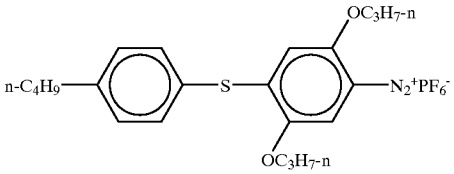
-continued
(V-4)
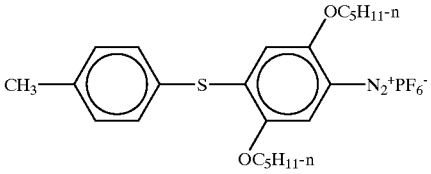
(V-5)
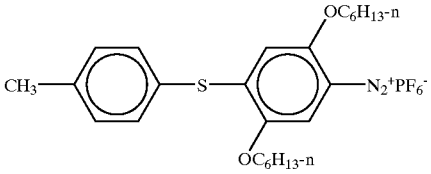
In the following, there will be shown specific examples of the coupler.
(B-1)
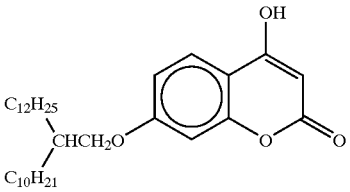
(B-2)
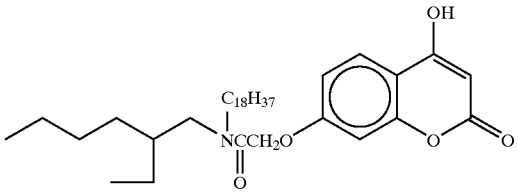
(B-3)
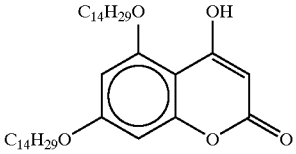
(B-4)
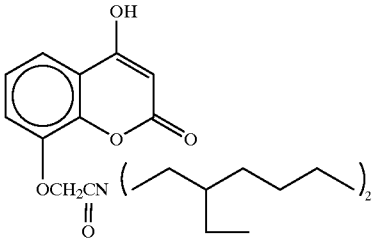
(B-5)
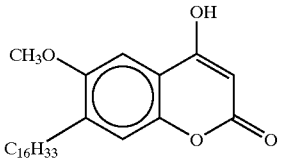
B-6)
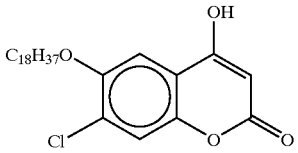
(B-7)
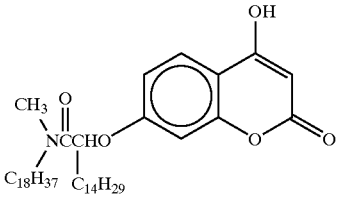
(B-8)
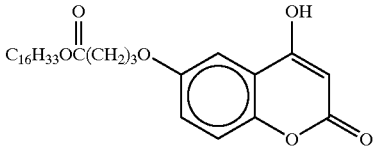
(B-9)
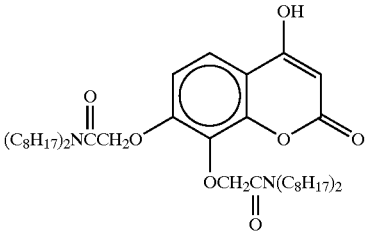
(B-10)
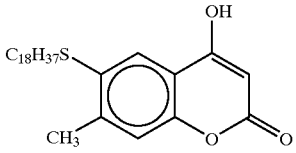

-continued
(B-11)
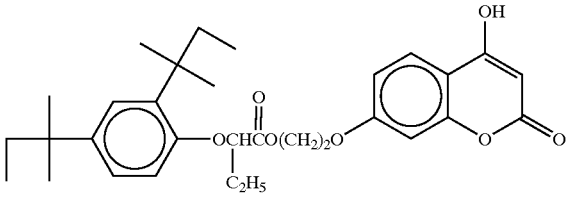
(B-12)
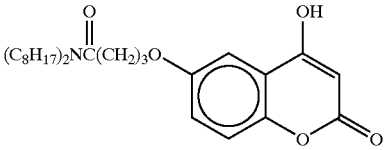
(B-13)
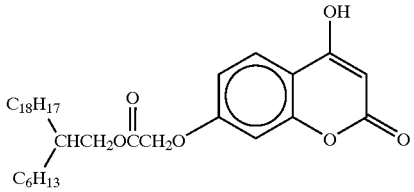
(B-14)
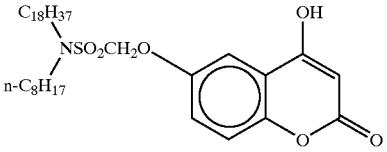
(B-15)
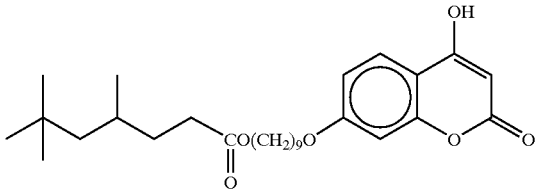
(B-16)
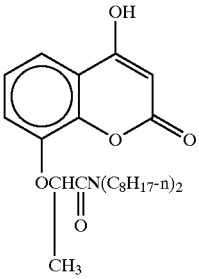
(B-17)
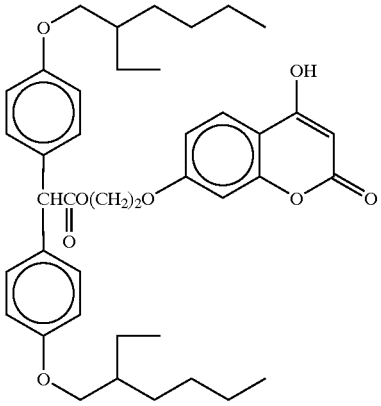
(B-18)
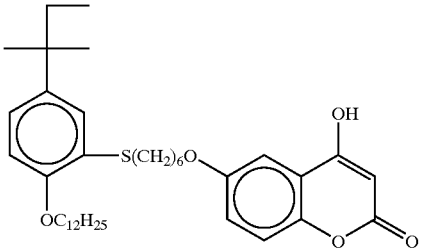
(B-19)
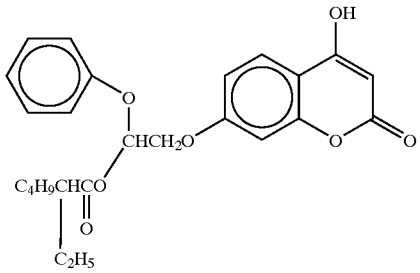
(B-20)
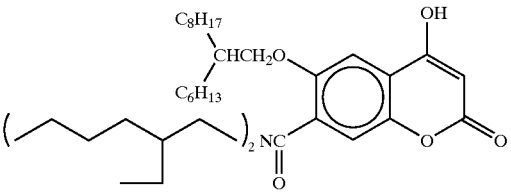
(B-21)
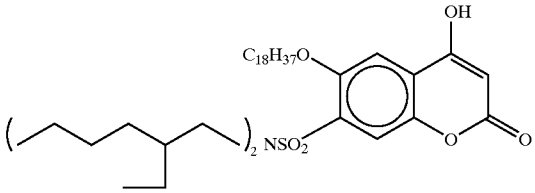
(B-22)
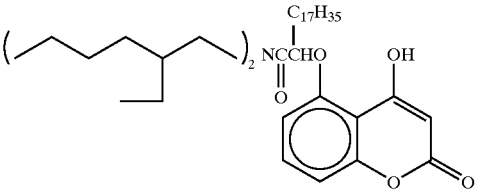

-continued
(B-23)
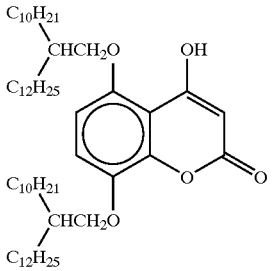
(B-24)
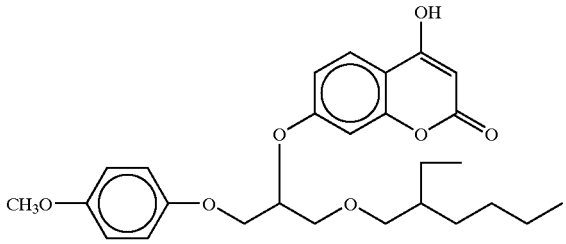
(B-25)
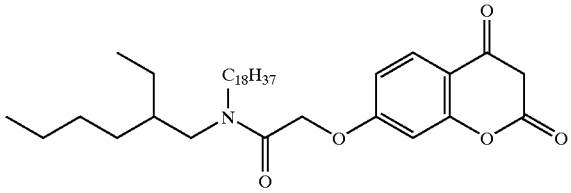
(1)
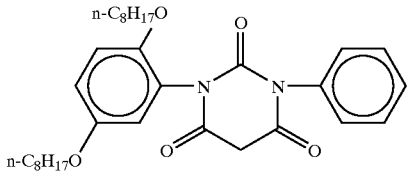
(2)
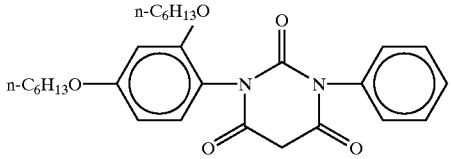
(3)
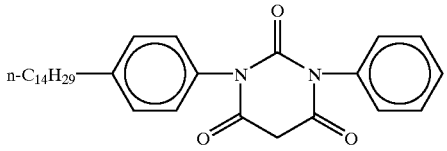
(4)
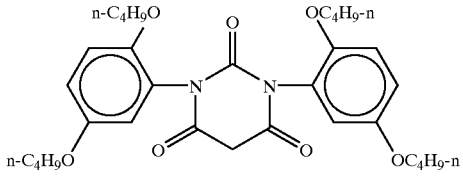
(5)
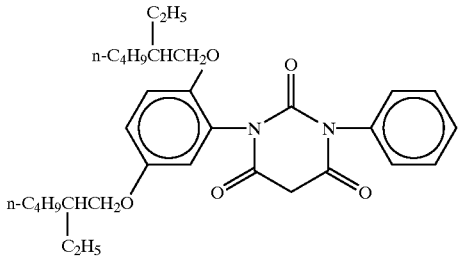
(6)
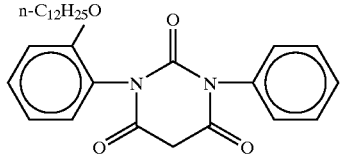
(7)
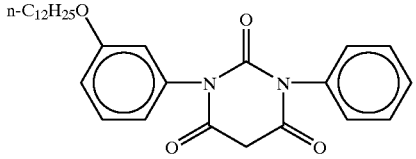
(8)
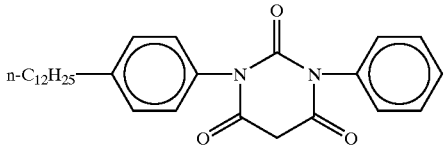
(9)
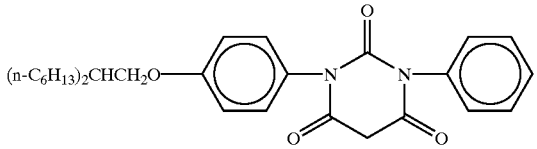
(10)
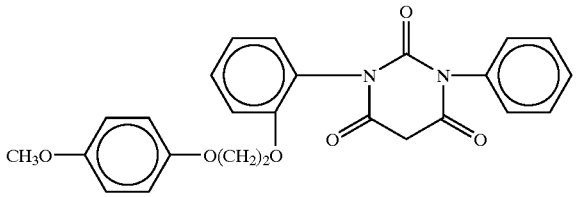
(11)
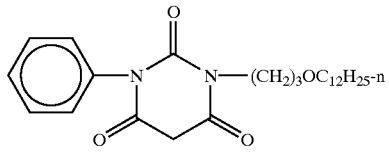

-continued
(12)
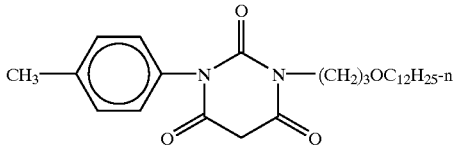
(13)
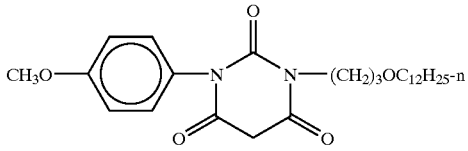
(14)
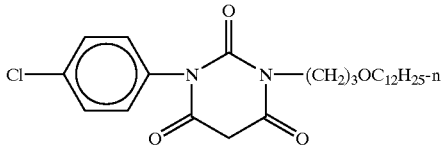
(15)
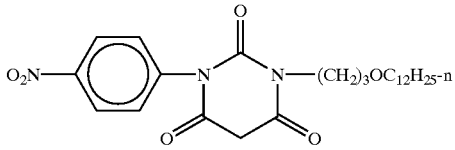
(16)
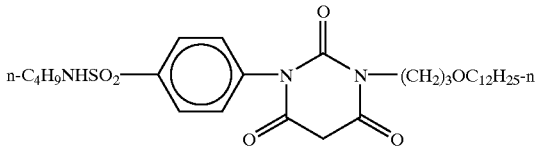
(17)
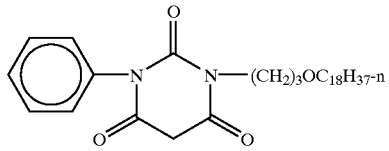
(18)
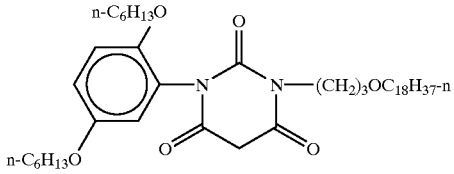
(19)
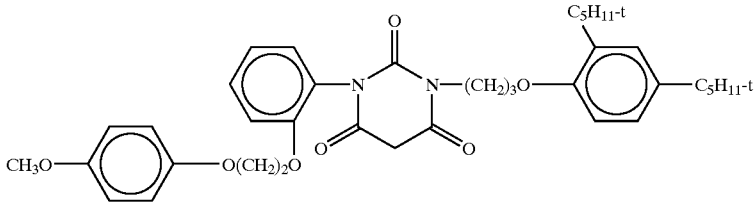
(20)
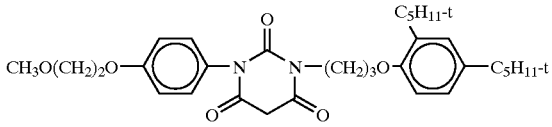
(21)
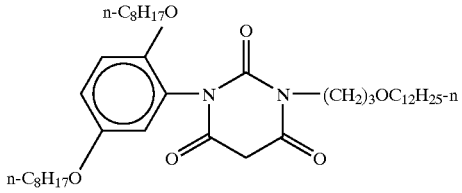
(22)
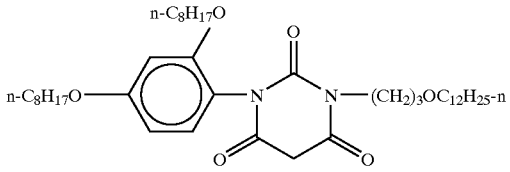
(23)
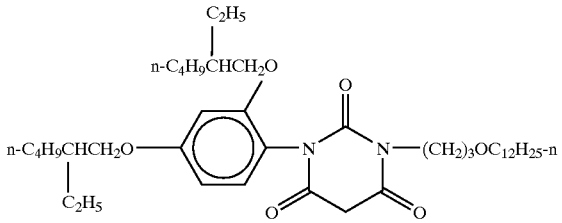
(24)
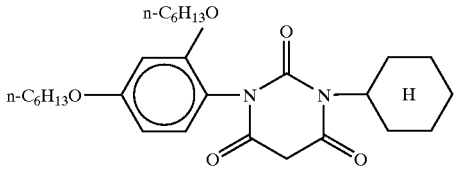
(25)
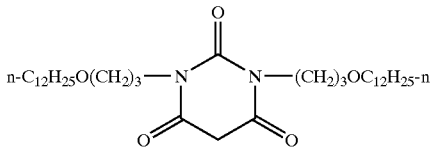

-continued
(26)
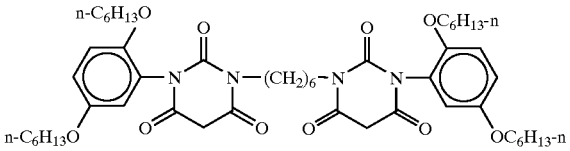
(27)
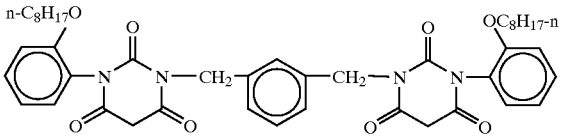
(28)
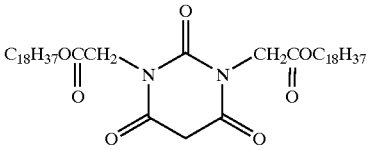
(II-1)
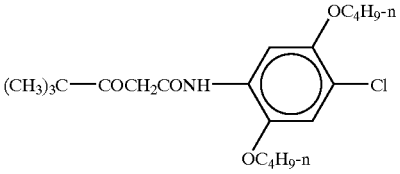
(II-2)
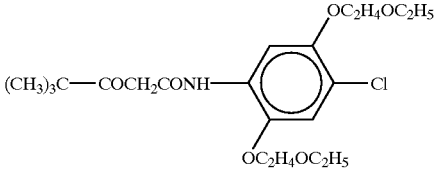
(II-3)
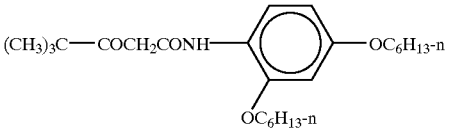
(II-4)
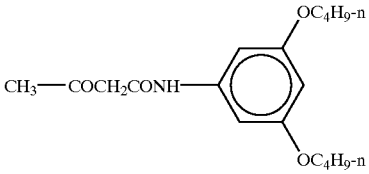
(II-5)
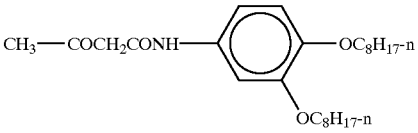
(II-6)
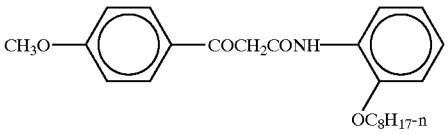
(II-7)
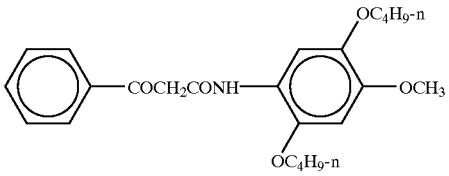
(II-8)
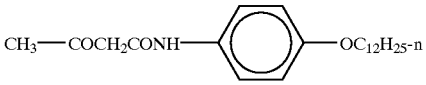
(II-9)
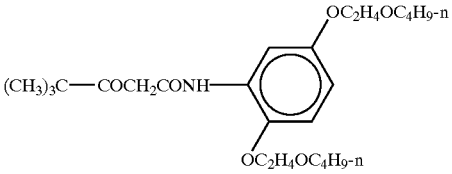
(II-10)
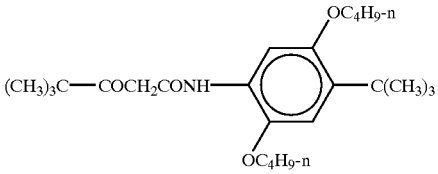
(II-11)
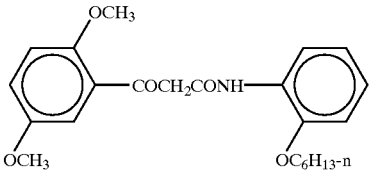
(VI-1)
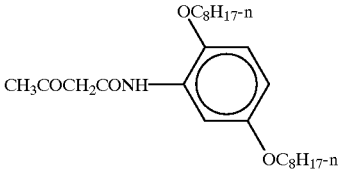
(VI-2)
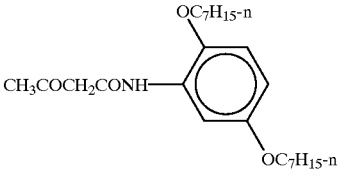

-continued (VI-3)

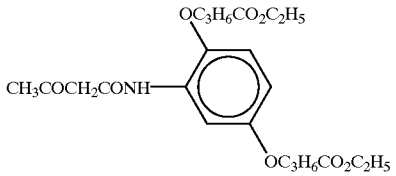

(VI-4)

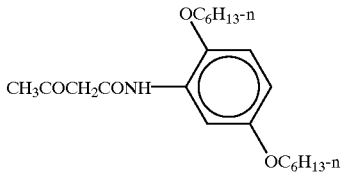

(VI-5)

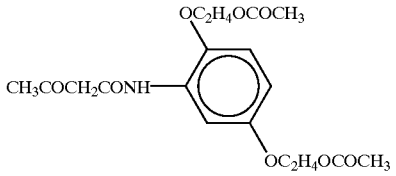

(VI-6)

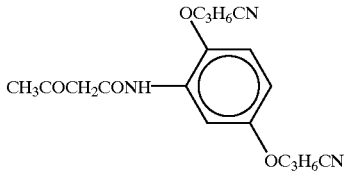

The above-mentioned base can be employed singly or in a combination of two or more kinds. The base can be a nitrogen-containing compound such as a tertiary amine, a peperidine, a piperadine, an amidine, a formamidine, a pyridine, a guanidine or a morpholine.

Particularly preferred is a piperadine such as N,N'-bis(3-phenoxy-2-hydroxypropyl)piperadine, N,N'-bis(3-(p-methylphenoxy))-2-hydroxypropyl)piperadine, N,N'-bis(3-(p-methoxyphenoxy)-2-hydroxypropyl)piperadine, N,N'-bis(3-phenylthio-2-hydroxypropyl)piperadine, N,N'-bis(3-(β-naphthoxy)-2-hydroxypropyl)piperadine, N-3-(β-naphthoxy)-2-hydroxypropyl-N'-methylpiperadine, or 1,4-bis((3-(N-methylpiperadino)-2-hydroxy)propylxoy)benzene; a morpholine such as N-(3-(β-naphthoxy)-2-hydroxy)propylmorpholine, 1,4-bis((3-morpholino-2-hydroxy)propyloxy)benzene or 1,3-bis((3-morpholino-2-hydroxy)propyloxy)benzene; a piperidine such as N-(3-phenoxy-2-hydroxypropyl)piperidine or N-dodecylpiperidine; or a guanidine such as triphenylguanidine, tricyclohexylguanidine or dicyclohexylphenylguanidine.

In the thermal recording material of the invention, the electron donating dye precursor is preferably included, together with the polymerizable compound having the ethylenic unsaturated bond, in microcapsules. For the microcapsules, there can be utilized already known microencapsulating methods. More specifically, the microcapsules can be prepared by dissolving the electron donating dye precursor, a microcapsule wall precursor and the polymerizable compound having the ethylenic unsaturated bond of the invention in an organic solvent which is insoluble or low-soluble in water, adding and dispersing an obtained solution in an aqueous solution of a water-soluble polymer into an emulsion by use of a homogenizer, and elevating the temperature thereby forming a polymer substance as a microcapsule wall at the oil/water interface as a wall film.

The organic solvent can be a low-boiling auxiliary solvent such as an acetate ester, methylene chloride or cyclohexane, and/or a phosphoric acid ester, a phthalic acid ester, an acrylic acid ester, a methacrylic acid ester, another carboxylic acid ester, a fatty acid amide, an alkylated biphenyl, an alkylated terphenyl, an alkylated naphthalene, diarylethane, chlorinated parafin, an alcoholic solvent, a phenolic solvent, an ether solvent, a monoolefin solvent, or an epoxy solvent. Specific examples include high-boiling oils such as tricresyl phosphate, trioctyl phosphate, octyldiphenyl phosphate, tricyclohexyl phosphate, dibutyl phthalate, dioctyl phthalate, dilauryl phthalate, dicyclohexyl phthalate, butyl oleate, diethylene glycol benzoate, dioctyl sebacate, dibutyl sebacate, dioctyl agipate, trioctyl trimellitate, acetyltriethyl citrate, octyl maleate, dibutyl maleate, isoamylbiphenyl, chlorinated parafin, diisopropylnaphthalene, 1,1'-ditolylethane, 2,4-ditertiary-amylphenol, N,N-dibutyl-2-butoxy-5-tertiary-octylaniline, hydroxybenzoic acid 2-ethylhexyl ester, and polyethylene glycol, among which particularly preferred are alcohol, phosphoric acid ester, carboxylic acid ester, alkylated biphenyl, alkylated terphenyl, alkylated naphthalene and diarylethane. To such high-boiling oil, there may be added an antioxidant such as a hindered phenol or a hindered amine. The oil desirably includes an unsaturated fatty acid, such as α-methylstyrene dimer or the like. For example, α-methylstyrene dimer is available as MSD100 (trade name) manufactured by Mitsui Toatsu Chemicals Inc.

The wall membrane of the microcapsules of the invention can be formed for example from a polyurethane resin, a polyurea resin or a polyurethane-polyurea resin (these collectively called polyurethane-polyurea resin) or from a polyisocyanate compound as a precursor. In addition to the above-mentioned resins, there can also be used a polyamide resin, a polyester resin, a polycarbonate resin, an amioaldehyde resin, a melamine resin, a polystyrene resin, a styrene-acrylate copolymer resin, a styrene-methacrylate copolymer resin, gelatin, polyvinyl alcohol and the like, as the wall material.

In case the microcapsules have a wall membrane formed by a polyurethane-polyurea resin, such microcapsules can be prepared by mixing a microcapsule wall precursor such as a polyvalent isocyanate in a core material to be encapsulated, dispersing and emulsifying such core material in an aqueous solution of a water-soluble polymer such as polyvinyl alcohol, and elevating the liquid temperature to induce a polymer forming reaction at the interface of oil droplets.

Examples of the polyvalent isocyanate include a diisocyanate such as m-phenylene diisocyanate, p-phenylene diisocyanate, 2,6-tolylene diisocyanate, 2,4-tolylene diisocyanate, naphthalene-1,4-diisocyanate, diphenylmethane-4,4'-diisocyanate, 3,3'-diphenylmethane-4,4,-diisocyanate, xylylene-1,4-diisocyanate, 4,4'-diphenylpropane diisocyanate, trimethylene diisocyanate, hexamethylene diisocyanate, propylene-1,2-diisocyanate, butylene-1,2-diisocyanate, cyclohexylene-1,2-diisocyanate, cyclohexylene-1,4-diisocyanate, 3',3-dimethoxy-biphenyl diisocyanate, xylylene-1,3-diisocyanate, 4-chloroxylylene-1,3-diisocyanate, 2-methylxylylene-1,3-diisocyanate, cyclohexylene-1,3-diisocyanate, 1,4-bis(isocyanatemethyl)-cyclohexane, or 1,3-bis(isocyanatemethyl)-cyclohexane; a triisocyanate such as 4,4',4"-triphenylmethane triisocyanate, or toluene-2,4,6-triisocyanate; a tetraisocyanate such as 4,4'-dimethyldiphenylmethane-2,2',5,5'-tetraisocyanate; and an isocyanate prepolymer such as an addition product of hexamethylene diisocyanate and trimethylolpropane, an addition product of 2,4-tolylene diisocyanate and trimethylolpropane, or an addition product of tolylenediisocyanate and hexanetriol. Also, if necessary, there may be used two or more compounds in combination. Among these, particularly preferred is a compound having three or more isocyanate groups in a molecule.

A particle size of the microcapsules is preferably within a range of 0.05 to 1.0 $\mu$m, more preferably 0.1 to 0.7 $\mu$m.

Also in the invention, in the recording layer including the diazonium salt compound and the coupler capable of generating a color by reaction with the diazonium salt compound, the diazonium salt compound may be included in the microcapsules. Such microcapsules can be prepared by a method similar to that employed for the microcapsules of the electron donating dye precursor.

In the present invention, for further reducing the coloration in the fading under light irradiation, there can be used a compound known as a reducing agent. In case the microcapsules are used, the reducing agent may be present inside or outside the microcapsules, but is preferably present inside the microcapsules. In case the reducing agent is present outside the microcapsules, the reducing agent enters the interior of the microcapsules at the printing under heating. Such additive can be a hydroquinone compound, a hydrazide compound, a hydroxy compound, a phenidone compound, a cathecol compound, a resorcinol compound, a hydroxyhydroquinone compound, a pyrrologlycinol compound, a phenol compound, a phenylhydrazide compound, a gallic acid compound, an ascorbic acid compound or an ethylene glycol compound. Such compounds are described for example in JP-A Nos. 3-191341, 3-25434, 1-252953, 2-302753, 1-129247, 1-227145, 1-243048 and 2-262649. Specific examples include N-phenylacetohydrazide, N-phenylbutyrylhydrazide, p-t-butylphenol, 2-azidebenzoxazole and following compounds:

R-1

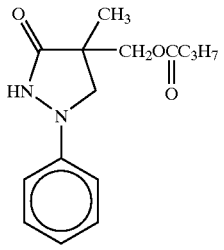

-continued

R-2

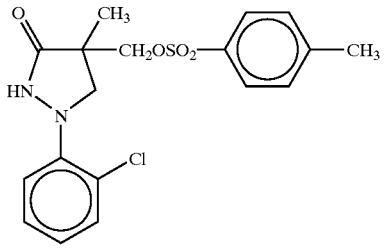

R-3

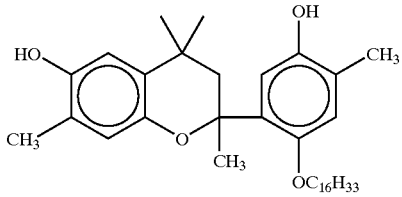

R-4

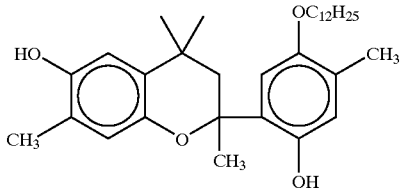

R-5

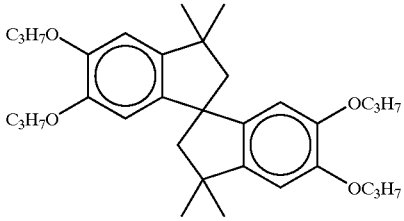

R-6

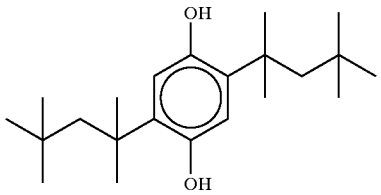

R-7

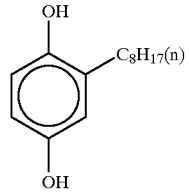

R-8

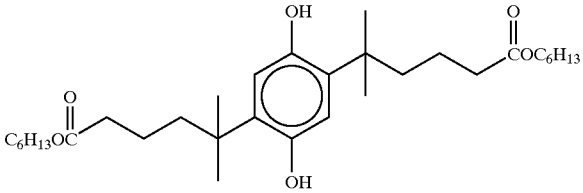

-continued

R-9

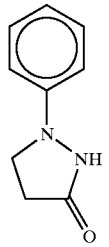

R-10

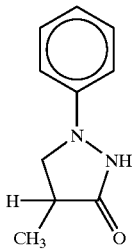

R-11

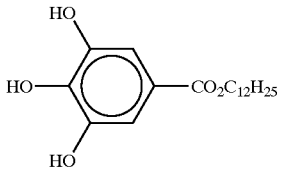

R-12

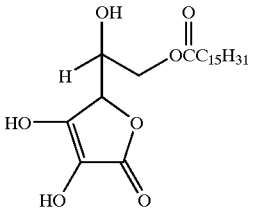

R-13

$CH_3—(OCH_2CH_2)_3—OCH_3$

R-14

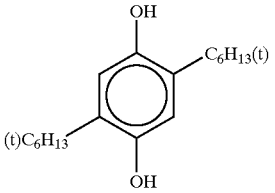

R-15

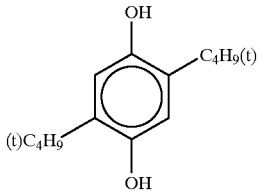

The thermal recording material of the present invention preferably includes, in addition to the recording layer, an intermediate layer, a protective layer and the like according to the necessity. Also there may be provided anew a layer containing a compound described in JP-A Nos. 7-276808, 9-1928, 9-39395, 9-39396, 9-95487, 9-301958, 11-291629, 6-191155 and 12-206644.

In the present invention, in the at least one recording layer, as explained in the foregoing, it is preferred that the electron donating dye precursor is included together with the polymerizable compound having the ethylenic unsaturated bond in the microcapsules, but the electron donating dye precursor, the electron accepting compound, the polymerization compound having the ethylenic unsaturated bond, the diazonium salt compound, the coupler generating the color by reaction with the diazonium salt compound, the basic substance and the sensitizer may also be used, in addition to the aforementioned method of inclusion in the microcapsules, for example in (1) a method of dispersion in a solid-phase, (2) a method of dispersion in an emulsion, (3) a method of dispersion in a polymer, or (4) a method of dispersion in a latex.

In the present invention, a multi-color thermal recording material can be obtained by laminating at least two recording layers explained in the foregoing and employing different colors in such recording layers. The layer configuration is not particularly restricted, but there is preferred a multi-color thermal recording material having two recording layers in which two diazonium salt compounds having different photosensitive wavelengths are respectively combined with couplers capable of developing different colors by reaction under heating with the respective diazonium salt compounds, and a recording layer in which an electron donating dye precursor and an electron accepting compound are combined. More specifically there are employed, on a support, a first recording layer including an electron donating dye precursor and an electron accepting compound, a second recording layer including a diazonium salt compound having a maximum absorption wavelength at 365±40 nm and a coupler capable of developing a color by reaction under heating with the diazonium salt compound, and a third recording layer including a diazonium salt compound having a maximum absorption wavelength at 425±40 nm and a coupler capable of developing a color by reaction under heating with the diazonium salt compound. In such example, a full-color image recording is possible by selecting three primary colors in the subtractive color mixing, namely yellow, magenta and cyan, for the color hues to be developed in these recording layers.

Recording in such multi-color thermal recording material is executed as follows. At first the third recording layer is heated to execute a color development by the diazonium salt compound and the coupler in such layer. Then, after an irradiation with the light of a wavelength of 425±40 nm to decompose the unreacted diazonium salt compound contained in the third recording layer, there is added a heat sufficient for color development in the second recording layer, thereby causing a color development by the diazonium salt compound and the coupler included in such layer. At the same time the third recording layer is also strongly heated, but no further color development takes place because the diazonium salt compound is already decomposed and the color developing ability is lost. Then an irradiation with the light of a wavelength of 365±40 nm is executed to decompose the diazonium salt compound included in the second recording layer, and there is added a heat sufficient for color development in the first recording layer, thereby developing a color therein. At the same time the third and second recording layers are also strongly heated, but no further color development takes place because the diazonium salt compounds are already decomposed so that the color developing ability is lost.

In the invention, in order to improve the light fastness, there may be employed a known antioxidant such as described in EP-A No. 310551, GP-A No.3435443, EP-A No. 310552, JP-A No. 3-121449, EP-A No. 459416, JP-A Nos. 2-262654, 2-71262 and 63-163351, U.S. Pat. No. 4,814,262, JP-A Nos. 54-48535, 5-61166 and 5-119449, U.S. Pat. No. 4,980,275, JP-A Nos. 63-113536 and 62-262047, and EP-A Nos. 223739, 309402 and 309401.

It is also effective to employ various additives already known in the thermal recording materials and in the pressure-sensitive recording materials. A part of examples of such antioxidant includes compounds described in JP-A Nos. 6-125470, 60-125471, 60-125472, 60-287485, 60-287486, 60-287487, 62-146680, 60-287488, 62-282885, 63-89877, 63-88380, 63-088381, 01-239282, 04-291685, 04-291684, 05-188687, 05-188686, 05-110490, 05-1108437, 05-170361, 63-203372, 63-224989, 63-267594, 63-182484, 60-107384, 60-107383, 61-160287, 61-185483, 61-211079, 63-251282 and 63-051174, and JP-B Nos. 48-043294 and 48-033212.

For a binder for the recording layer, there can be employed an already known material, for example a water-soluble polymer such as polyvinyl alcohol or gelatin, or a polymer latex.

<Support>

For a support in the invention, there can be employed a plastic film, paper, plastic/resin-coated paper, synthetic paper or the like.

<Optical Transmittance Regulating Layer>

An optical transmittance regulating layer contains a component, which functions as a precursor for an ultraviolet absorber, because such component does not function as an ultraviolet absorber prior to the irradiation with the light of a wavelength region required for fixation, shows a high optical transmittance thereby sufficiently transmitting the light of the wavelength region required for fixation at the fixation of a recording layer, and also shows a high optical transmittance in the visible region thereby not hindering the fixation of the recording layer. Characteristics of the optical transmittance regulating layer can be selected arbitrarily according to the characteristics of the recording layer.

After the irradiation of the light of the wavelength region required for the fixation of the recording layer by the light irradiation, the precursor of the ultraviolet absorber becomes functionable as an ultraviolet absorber by reaction with light or heat, which absorbs most of the light of the ultraviolet wavelength region required for the fixation thereby reducing the transmittance and improving the light fastness of the thermal recording material, but the transmittance for the visible light remains substantially unchanged because of the absence of an absorbing effect for the visible light.

In the present invention, for the compound to be included in the optical transmittance regulating layer, there can be for example utilized a compound described in JP-A No. 9-1928.

The optical transmittance regulating layer is preferably provided in at least a unit in the photo-fixable thermal recording material, and most preferably provided between a photo-fixable magenta recording layer and a protective layer constituting an outermost layer.

<Intermediate Layer>

For the purpose of preventing color mixing between the recording layers, an intermediate layer may be provided between the recording layers. Such intermediate layer is preferably formed by a water-soluble polymer compound such as gelatin, phthalated gelatin, polyvinyl alcohol, denatured polyvinyl alcohol, polyvinylpyrrolidone, methylcellulose, sodium polystyrenesulfonate or a styrene-maleic acid copolymer, and may include various additives.

Also in case of using a support with a high $O_2$ transmission rate such as a laminated paper, an undercoat layer may be provided as an $O_2$ intercepting layer thereby improving the light fastness.

In the intermediate layer and the undercoat layer, it is effective to include a swellable inorganic laminar compound described in Japanese Patent Application No. 7-113825, for achieving prevention of color mixing and improvement of light fastness in a smaller layer thickness.

<Protective Layer>

In the thermal recording material of the invention, a protective layer may be provided on the recording layer according to the necessity. Such protective layer may also be laminated in two or more layers, according to the necessity.

A material to be used in the protective layer can be, for example, a water-soluble polymer compound such as polyvinyl alcohol, carboxy-denatured polyvinyl alcohol, vinyl acetate-acrylamide copolymer, silicon-denatured polyvinyl alcohol, starch, denatured starch, methylcellulose, carboxymethylcellulose, hydroxymethylcellulose, gelatin, gum Arabic, casein, a styrene-maleic acid copolymer hydrolyzate, a styrene-maleic acid copolymer half ester hydrolyzate, an isobutylene-maleic acid anhydride copolymer hydrolyzate, a polyacrylamide derivative, polyvinylpyrrolidone, sodium polystyrenesulfonate or sodium alginate; or a latex such as styrene-butadiene rubber latex, acrylonitrile-butadiene rubber latex, methyl acrylate-butadiene rubber latex or vinyl acetate emulsion.

The above-mentioned water-soluble polymer compound may be crosslinked to further improve the stability in storage. The crosslinking agent can be suitably selected from the already known ones, and can be, for example, a water-soluble initial condensate such as N-methylolurea, N-methylolmelamine or urea-formalin; a dialdehyde compound such as glyoxal or glutaraldehyde; an inorganic crosslinking agent such as boric acid or borax; or polyamide epichlorohydrin.

The protective layer may be further added with a pigment, a metal soap, a wax, a surfactant, a releasing agent or the like known in the related art.

The protective layer preferably has a dry coating amount within a range of 0.2 to 5 g/m$^2$, more preferably 0.5 to 2 g/m$^2$, and a film thickness preferably within a range of 0.2 to 5 $\mu$m, more preferably 0.5 to 2 $\mu$m.

In case the protective layer is provided, a known ultraviolet absorber or a precursor thereof may be included in the protective layer.

The protective layer may be provided by a known coating method as explained in the foregoing in forming the recording layer on the support.

EXAMPLES

In the following, the present invention will be further clarified by examples, but the invention is not at all limited by such examples. In the following description, "part" and "%" respectively means "part by mass" and "mass %".

Example 1

<Preparation of Phthalated Gelatin Solution>

32 parts of phthalated gelatin (trade name: MGP gelatin, manufactured by Nippi Collagen Co.), 0.9143 parts of 1,2-benzothiazolin-3-one (3.5% methanol solution, manufactured by Daito Chemical Industries, Co.), and 367.1 parts of distilled water were mixed and dissolved at 40° C. to obtain an aqueous solution of phthalated gelatin.

<Preparation of Alkali-Processed Gelatin Solution>

25.5 parts of alkali-processed low-ion gelatin (trade name: #750 gelatin, manufactured by Nitta Gelatin Co.), 0.7286 parts of 1,2-benzothiazolin-3-one (3.5% methanol solution, manufactured by Daito Chemical Industries, Co.), 0.153 parts of calcium hydroxide and 143.6 parts of ion-exchanged water were mixed and dissolved at 50° C. to obtain an aqueous gelatin solution for preparing an emulsion.

(1) Preparation of Coating Liquid for Yellow Recording Layer

<Preparation of Microcapsule Liquid (a) Including Diazonium Salt Compound>

In 16.1 parts of ethyl acetate, 2.2 parts of a following diazonium compound (A) (maximum absorption wavelength 420 nm), 2.2 parts of a following diazonium compound (B) (maximum absorption wavelength 420 nm), 4.8 parts of monoisopropylbiphenyl, 4.8 parts of diphenyl phthalate and 0.4 parts of diphenyl-(2,4,6-trimethylbenzoyl) phosphin oxide (trade name: Lucirin TPO, manufactured by BASF Japan Co.) were added and dissolved uniformly by heating at 40° C. To thus obtained mixture liquid, 8.6 parts of a mixture of xylylene diisocyanate/trimethylolpropane addition product and xylylene diisocyanate/bisphenol A addition product (trade name: Takenate D119N (50% solution in ethyl acetate), manufactured by Takeda Chemical Industries, Ltd.) were added as a capsule wall material and were uniformly agitated to obtain a mixture liquid (I).

Diazonium salt compound A

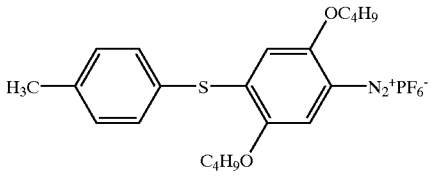

Diazonium salt compound B

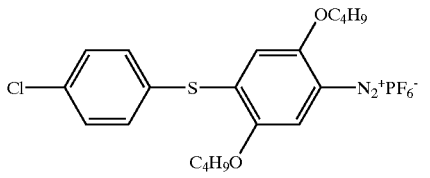

Separately, 58.6 parts of the above-mentioned phthalated gelatin aqueous solution were added with 16.3 parts of ion-exchanged water and 0.34 parts of Scraph AG-8 (50%) (manufacture by Nippon Seika Co.) to obtain a mixture liquid (II).

The mixture liquid (I) was added to the mixture liquid (II), and was dispersed and emulsified with a homogenizer (manufactured by Nippon Seiki Mfg. Co.) at 40° C. The obtained emulsion was added and mixed uniformly with 20 parts of water, and was subjected to an encapsulation reaction for 3 hours under agitation at 40° C. thereby eliminating ethyl acetate. Thereafter 4.1 parts of ion exchange resin Amberlite IRA68 (manufactured by Organo Corp.) and 8.2 parts of Amberlite IRC50 (manufactured by Organo Corp.) were added and the mixture was agitated further for 1 hour. Thereafter the ion exchange resin was eliminated by filtration, and the capsule liquid was subjected to an adjustment of concentration so as to obtain a solid content of 20.0%, thereby obtaining a microcapsule liquid (a) including the diazonium salt compound. The obtained microcapsules had a median diameter of 0.36 μm, as a result of a particle size measurement with LA-700 (manufactured by Horiba Mfg. Co.).

<Preparation of Coupler Compound Emulsin (a)>

In 33.0 parts of ethyl acetate, there were dissolved 9.9 parts of a following coupler compound (C), 9.9 parts of triphenylguanidine (manufactured by Hodogaya Chemical Co.), 20.8 parts of 4,4'-(m-phenylenediisopropylidene)-diphenol (trade name: Bisphenol M, manufactured by Mitsui Petrochemicals Inc.), 3.3 parts of 3,3,3',3'-tetramethyl-5,5',6,6'-tetra(1-propyloxy)-1,1'-spirobisindane, 13.6 parts of 4-(2-ethylhexyloxy)benzenesulfonic acid amide (manufactured by Manac Co.), 6.8 parts of 4-n-pentyloxybenzenesulfonic acid amide (manufactured by Manac Co.) and 2.4 parts of calcium dodecylbenzenesulfonate (trade name: Pionin A-41-C (70% methanol solution), manufactured by Takemoto Yushi Co.) to obtain a mixture liquid (III).

Coupler compound C

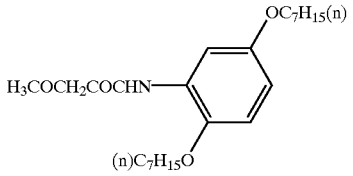

Separately, 206.3 parts of the above-mentioned alkali-process gelatin aqueous solution were mixed with 107.3 parts of ion-exchanged water to obtain a mixture liquid (IV).

The mixture liquid (IV) was added to the mixture liquid (III), and was dispersed and emulsified with a homogenizer (manufactured by Nippon Seiki Mfg. Co.) at 40° C. The obtained emulsion of the coupler compound was heated under a reduced pressure to eliminate ethyl acetate, and was subjected to an adjustment of concentration so as to obtain a solid content of 26.5%, thereby obtaining a microcapsule liquid (a) including the diazonium salt compound. The obtained emulsion of the coupler compound had a median diameter of 0.21 μm, as a result of a particle size measurement with LA-700 (manufactured by Horiba Mfg. Co.).

Then, 9 parts of SBR latex (trade name: SN-307 (48% liquid, manufactured by Sumika ABS Latex Co.), adjusted to a concentration of 26.5%, were added to 100 parts of the aforementioned emulsion of coupler compound and were uniformly agitated to obtain an emulsion (a) of the coupler compound.

<Preparation of Coating Liquid (a)>

The microcapsule liquid (a) including the diazonium salt compound and the emulsion (a) of the coupler compound were mixed in such a manner that the mass ratio of the included coupler compound/diazonium compound becomes 2.2/1, thereby obtaining a coating liquid (a) for the recording layer.

(2) Preparation of Coating Liquid for Magenta Recording Layer

<Preparation of Microcapsule Liquid (b) Including Diazonium Salt Compound>

In 15.1 parts of ethyl acetate, 2.8 parts of a following diazonium compound (D) (maximum absorption wavelength 365 nm), 3.8 parts of diphenyl phthalate, 3.9 parts of phenyl 2-benzoyloxybenzoate and 0.1 parts of calcium dodecylbenzenesulfonate (trade name: Pionin A-41-C, 70% methanol solution, manufacture by Takemoto Yushi Co.) were added and uniformly dissolved under heating. To thus obtained mixture liquid, 2.5 parts of a mixture of xylylene diisocyanate/trimethylolpropane addition product and xylylene diisocyanate/bisphenol-A addition product (trade name: Takenate D119N (50% solution in ethyl acetate), manufactured by Takeda Chemical Industries, Ltd.) and 6.8 parts of a xylylene diisocyanate/trimethylolpropane addition product (trade name: Takenate D110N (75% ethyl acetate solution) manufactured by Takeda Chemical Industries, Ltd.) were added as a capsule wall material and uniformly agitated to obtain a mixture liquid (V).

Diazonium salt compound D

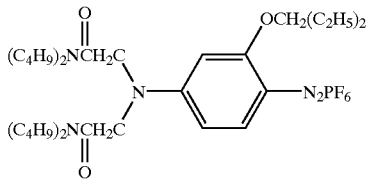

Separately, 55.3 parts of the above-mentioned phthalated gelatin aqueous solution were added with 21.0 parts of ion-exchanged water to obtain a mixture liquid (VI).

The mixture liquid (V) was added to the mixture liquid (VI), and was dispersed and emulsified with a homogenizer (manufactured by Nippon Seiki Mfg. Co.) at 40° C. The obtained emulsion was added and mixed uniformly with 24 parts of water, and was subjected to an encapsulation reaction for 3 hours under agitation at 40° C. thereby eliminating ethyl acetate. Thereafter 4.1 parts of ion exchange resin Amberlite IRA68 (manufactured by Organo Corp.) and 8.2 parts of Amberlite IRC50 (manufactured by Organo Corp.) were added and the mixture was agitated further for 1 hour. Thereafter the ion exchange resin was eliminated by filtration, and the capsule liquid was subjected to an adjustment of concentration so as to obtain a solid content of 20.0%, thereby obtaining a microcapsule liquid (b) including the diazonium salt compound. The obtained microcapsules had a median diameter of 0.43 μm, as a result of a particle size measurement with LA-700 (manufactured by Horiba Mfg. Co.).

<Preparation of Coupler Compound Emulsion (b)>

In 36.9 parts of ethyl acetate, there were dissolved 11.9 parts of a following coupler compound (E), 14.0 parts of triphenylguanidine (manufactured by Hodogaya Chemical Co.), 14.0 parts of 4,4'-(m-phenylenediisopropylidene)-diphenol (trade name: Bisphenol M, manufactured by Mitsui Petrochemicals Inc.), 14 parts of 1,1-(p-hydroxyphenyl)-2-ethylhexane, 3.5 parts of 3,3,3',3'-tetramethyl-5,5',6,6'-tetra (1-propyloxy)-1,1'-spiroindane, 3.5 parts of a following compound (G), 1.7 parts of tricresyl phosphate, 0.8 parts of diethyl maleate, and 4.5 parts of calcium dodecylbenzenesulfonate (trade name: Pionin A-41-C (70% methanol solution), manufactured by Takemoto Yushi Co.) to obtain a mixture liquid (VII).

Coupler compound E

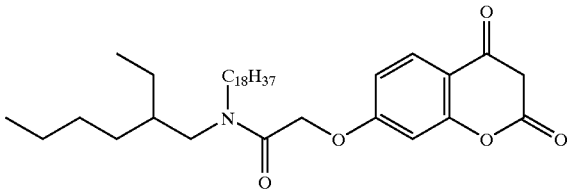

Compound (G)

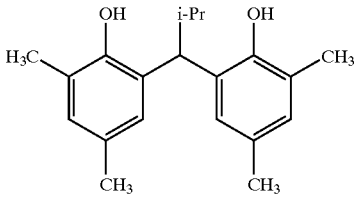

Separately, 206.3 parts of the above-mentioned alkali-process gelatin aqueous solution were mixed with 107.3 parts of ion-exchanged water to obtain a mixture liquid (VIII).

The mixture liquid (VII) was added to the mixture liquid (VIII), and was dispersed and emulsified with a homogenizer (manufactured by Nippon Seiki Mfg. Co.) at 40° C. The obtained emulsion of the coupler compound was heated under a reduced pressure to eliminate ethyl acetate, and was subjected to an adjustment of concentration so as to obtain a solid content of 24.5%, thereby obtaining a microcapsule liquid (b) including the diazonium salt compound. The obtained emulsion of the coupler compound had a median diameter of 0.22 μm, as a result of a particle size measurement with LA-700 (manufactured by Horiba Mfg. Co.).

<Preparation of Coating Fluid (b)>

The microcapsule liquid (b) including the diazonium salt compound and the emulsion (b) of the coupler compound were mixed in such a manner that the mass ratio of the included coupler compound/diazonium compound becomes 3.5/1. Also an aqueous solution (5%) of polystyrenesulfonic acid (partially neutralized with potassium hydroxide) was mixed in an amount of 0.2 parts with respect to 10 parts of the capsule liquid, thereby obtaining a coating liquid (b) for the recording layer.

(3) Preparation of Coating Liquid for Cyan Recording Layer

<Preparation of Microcapsule Liquid (c) Including Electron Donating Dye Precursor>

In 18.1 parts of ethyl acetate, 7.6 parts of a following electron donating dye (H), 8.0 parts of a following compound (1), and 8.0 parts of a mixture of 1-methylpropylphenyl-phenylmethane and 1-(-methylpropyl-phenyl)-2-phenylethane (trade name: Hisol SAS-310, manufactured by Japan Petroleum Co,) were added and uniformly dissolved under heating. To thus obtained mixture liquid, 9.6 parts of a xylylene diisocyanate/trimethylolpropane addition product (trade name: Takenate D110N (75% ethyl acetate solution) manufactured by Takeda Chemical Industries, Ltd.), and 5.3 parts of polymethylene polyphenyl polyisocyanate (trade name: Millionate MR-200, manufactured by Nippon Polyurethane Industries, Ltd.) were added as a capsule wall material and uniformly agitated to obtain a mixture liquid (IX).

Electron donating dye (H)

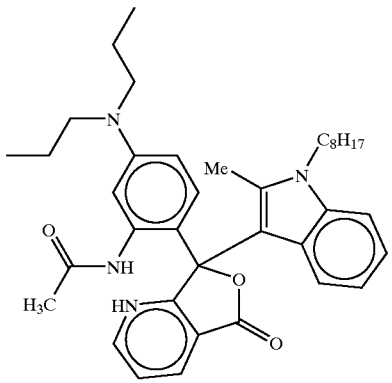

Compound (1)

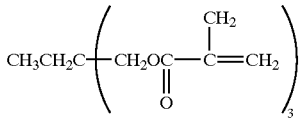

Separately, 28.8 parts of the above-mentioned phthalated gelatin aqueous solution were added with 9.5 parts of ion-exchanged water, 0.17 parts of Scraph AG-8 (50%) (manufacture by Nippon Seika Co.), and 4.3 parts of sodium dodecylbenzenesulfonate (10% aqueous solution) to obtain a mixture liquid (X).

The mixture liquid (IX) was added to the mixture liquid (X), and was dispersed and emulsified with a homogenizer (manufactured by Nippon Seiki Mfg. Co.) at 40° C. The obtained emulsion was added and mixed uniformly with 21.2 parts of water and 0.12 parts of tetraethylene pentamine, and was subjected to an encapsulation reaction for 3 hours under agitation at 65° C. thereby eliminating ethyl acetate, and the concentration was so adjusted to obtain a solid concentration of 33% in the liquid, thereby obtaining a microcapsule liquid. The obtained microcapsules had a median diameter of 1.10 μm, as a result of a particle size measurement with LA-700 (manufactured by Horiba Mfg. Co.).

Then 100 parts of the microcapsule liquid were added with 4.0 parts of a 25% aqueous solution of sodium dodecylbenzenesulfonate, and further with 4.3 parts of a fluorescent whitening agent containing a 4,4'-bistriazinylaminostylbene-2,2'-disulfonic acid derivative (trade name: Kaycoll BXNL, manufactured by Nippon Soda Co.) and uniformly agitated to obtain a microcapsule dispersion (c).

<Preparation of Electron Accepting Compound Dispersion (c)>

11.3 parts of the phthalated gelatin aqueous solution were added with 30.1 parts of ion-exchanged water, 15 parts of 4,4'-p-phenylenediisopropylidene)diphienol (trade name: Bisphenol P, manufactured by Mitsui Petrochemicals Inc.) and 3.8 parts of a 2% aqueous solution of sodium 2-ethylhexylsuccinate and were dispersed overnight with a ball mill to obtain a dispersion. The dispersion had a solid content of 26.6%.

100 parts of the dispersion were added with 45.2 parts of the alkali-processed gelatin aqueous solution, then agitated for 30 minutes, and were added with ion-exchanged water so as to obtain a solid content of 23.5% thereby obtaining a dispersion (c) of the electron accepting compound.

<Preparation of Coating Liquid (c)>

The microcapsule liquid (c) including the electron donating dye precursor and the emulsion (c) of the electron accepting compound were mixed in such a manner that the mass ratio of the electron accepting compound/electron donating dye precursor becomes 10/1, thereby obtaining a coating liquid (c) for the recording layer.

<Preparation of Coating Liquid for Intermediate Layer>

100.0 parts of alkali-processed low-ion gelatin (trade name: #750 gelatin, manufactured by Nitta Gelatin Co.), 2.857 parts of 1,2-benzothiazolin-3-one (3.5% methanol solution, manufactured by Daito Chemical Industries, Co.), 0.5 parts of calcium hydroxide and 521.643 parts of ion-exchanged water were mixed and dissolved at 50° C. to obtain an aqueous gelatin solution for preparing an intermediate layer.

10.0 parts of the gelatin aqueous solution for preparing the intermediate layer, 0.05 parts of sodium (4-nonylphenoxytrioxyethylene)butylsulfonate (2.0% aqueous solution, manufactured by Sankyo Chemicals Co.), 1.5 parts of boric acid (4.0% aqueous solution), 0.19 parts of an aqueous solution (5%) of polystyrenesulfonic acid (partially neutralized with potassium hydroxide), 3.42 parts of a 4% aqueous solution of a following compound (J) (manufactured by Wako Pure Chemical Co.), 1.13 parts of a 4% aqueous solution of a following compound (J') and 0.67 parts of ion-exchanged water were mixed to obtain a coating liquid for the intermediate layer.

Compound (J)

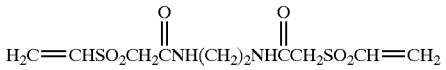

Compound (J')

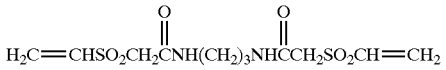

<Preparation of Coating Liquid for Optical Transmittance Regulating Liquid>

(iii-1) Preparation of Microcapsule Liquid of Ultraviolet Absorber Precursor

In 71 parts of ethyl acetate, there were uniformly dissolved 14.5 parts of [2-allyl-6-(2H-benzotriazol-2-yl)-4-t-octylphenyl]benzenesulfonate as an ultraviolet absorber precursor, 5.0 parts of 2,2'-t-octylhydroquinone 1.9 parts of tricresyl phosphate, 5.7 parts of α-methylstyrene dimer (trade name: MSD-100, manufactured by Mitsui Chemicals Inc.), and 0.45 parts of calcium dodecylbenzenesulfonate (trade name: Pionin A-41-C (70% methanol solution), manufactured by Takemoto Yushi Co.). In this mixture liquid, there were added 54.7 parts of a xylylene diisocyanate/trimethylolpropane addition product (trade name: Takenate D110N (75% ethyl acetate solution), manufacture by Takeda Chemical Industries Ltd.) as a capsule wall material, and the mixture was uniformly agitated to obtain a mixture liquid (XI) of the ultraviolet absorber precursor.

Separately, 52 parts of itaconic acid-denatured polyvinyl alcohol (trade name: KL-318, manufactured by Kuraray Co.) were mixed with 8.9 parts of a 30% aqueous solution of phosphoric acid, and 532.6 parts of ion-exchanged water to obtain a polyvinyl alcohol (PVA) aqueous solution for a microcapsule liquid of the ultraviolet absorber precursor.

The mixture liquid (XI) of the ultraviolet absorber precursor was added to 516.06 parts of the aqueous PVA solution for the ultraviolet absorber precursor microcapsule liquid, and was dispersed and emulsified with a homogenizer (manufactured by Nippon Seiki Mfg. Co.) at 20° C. The obtained emulsion was added and mixed uniformly with 254.1 parts of ion-exchanged water, and was subjected to an encapsulation reaction for 3 hours under agitation at 40° C. Thereafter 94.3 parts of ion exchange resin Amberlite MB-3 (manufactured by Organo Corp.) were added and the mixture was agitated further for 1 hour. Thereafter the ion exchange resin was eliminated by filtration, and the capsule liquid was subjected to an adjustment of concentration so as to obtain a solid content of 9.8%. The obtained microcapsules had a median diameter of 0.23±0.05 μm, as a result of a particle size measurement with LA-700 (manufactured by Horiba Mfg. Co.). 859.1 parts of the microcapsule liquid were mixed with 2.416 parts of carboxy-denatured styrene-butadiene latex (trade name: SN-307 (48% aqueous solution), manufactured by Sumitomo Naugatac Co., Ltd.) and 39.5 parts of ion-exchanged water to obtain a microcapsule liquid of the ultraviolet absorber precursor.

(iii-2) Preparation of Coating Liquid for Optical Transmittance Regulating Layer 1000 parts of the microcapsule liquid of the ultraviolet absorber precursor, 5.2 parts of a following compound (K) (trade name: Megafac F-120, 5% aqueous solution, manufactured by Dai-Nippon Inks and Chemicals Industries, Ltd.), 7.75 parts of a 4% aqueous solution of sodium hydroxide and 73.39 parts of sodium (4-nonylphenoxytrioxyethylene)butylsulfonate (2.0% aqueous solution, manufactured by Sankyo Chemicals Co. Ltd.) to obtain a coating liquid for the optical transmittance regulating layer.

Compound (K)

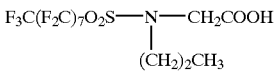

<Preparation of Coating Liquid for Protective Layer>

(iv-1) Preparation of Polyvinyl Alcohol Solution for Protective Layer 260 parts of a vinyl alcohol-alkylvinyl ether copolymer (trade name: EP-130, manufactured by Denka Corp.), 8.74 parts of a mixture liquid of sodium alkylsulfonate and a polyoxyethylene alkylether phosphoric acid ester (trade name: Neoscore CM-57 (54% aqueous solution), manufactured by Toho Chemical Industries, Co.) and 3832 parts of ion-exchanged water were mixed and uniformly dissolved for 1 hour at 90° C. to obtain a polyvinyl alcohol solution for the protective layer.

(iv-2) Preparation of Pigment Dispersion for Protective Layer 8 parts of barium sulfate (trade name: BF-21F, barium sulfate content 93% or higher, manufactured by Sakai Chemical Industries, Co.) were mixed with 0.2 parts of an anionic special polycarboxylic acid polymer surfactant (trade name: Poise 532A (40% aqueous solution), manufactured by Kao Corp.) and 11.8 parts of ion-exchanged water and were dispersed in a Dyno mill to prepare a pigment dispersion for the protective layer. The dispersion had a median diameter of 0.15 $\mu$m or less as a result of a particle size measurement with LA-910 (manufactured by Horiba Mfg. Co.).

45.6 parts of the above-mentioned barium sulfate dispersion were added with 8.1 parts of colloidal silica (trade name: Snowtex-O (20% aqueous dispersion), manufactured by Nissan Chemicals Inc.) to obtain a desired dispersion.

(iv-3) Preparation of Dispersion of Matting Agent for Protective Layer 220 parts of wheat starch (trade name: Wheat starch S, manufactured by Shinshin Shokuryou Kougyou Co.) were mixed with 3.81 parts of an aqueous dispersion of 1-2benzisothiazolin-3-one (trade name: PROXEL B.D, manufactured by I.C.I. Ltd.) and 1976.19 parts of ion-exchanged water and were dispersed uniformly to obtain a dispersion of the matting agent for the protective layer.

(iv-4) Preparation of Coating Blend Liquid for Protective Layer 1000 parts of the polyvinyl alcohol solution for the protective layer were uniformly mixed with 40 parts of a fluorinated surfactant (trade name: Megafac F-120, 5% aqueous solution, manufactured by Dai-Nippon Inks and Chemicals Industries, Ltd.), 50 parts of sodium (4-nonylphenoxytrioxyethylene)butylsulfonate (2.0% aqueous solution, manufactured by Sankyo Chemicals, Inc.), 49.87 parts of the pigment dispersion for the protective layer, 16.65 parts of the dispersion of the matting agent for the protective layer, 48.7 parts of a zinc stearate dispersion (trade name: Hydrin F115, 20.5% aqueous solution, manufactured by Chukyo Yushi Co.) and 280 parts of ion-exchanged water to obtain a coating blend liquid for the protective layer.

Support with Undercoat Layer

<Preparation of Undercoating Liquid>

40 parts of enzyme-decomposed gelatin (average molecular weight: 10000, viscosity by PAGI method: 15 mP, jelly strength by PAGI method: 20 g) were mixed with 60 parts of ion-exchanged water and dissolved under agitation at 40° C. to obtain an aqueous gelatin solution for the undercoat layer.

Separately, 8 parts of synthetic mica (aspect ratio: 1000, trade name: Somashif ME100, manufactured by Cope Chemical Inc.) were mixed with 92 parts of water and subjected to wet dispersion in a Visco mill to obtain a mica dispersion with an average particle size of 2.0 $\mu$M. The mica dispersion was added with water so as to obtain a mica concentration of 5% and was uniformly mixed to obtain a desired mica dispersion.

To 100 parts of the 40% aqueous gelatin solution at 40° C., 120 parts of water and 556 parts of methanol were added and sufficiently mixed under agitation, then 208 parts of the 5% mica dispersion were added and sufficiently mixed under agitation, and 9.8 parts of a 1.66% polyethylene oxide surfactant were added. Then, at a liquid temperature maintained at 35 to 40° C., 7.3 parts of a gelatin hardening agent, formed by an epoxy compound, were added to obtain a coating liquid (5.7%) for the undercoat layer.

<Preparation of Support with Undercoat Layer>

A wood pulp, composed of 50 parts of LBPS and 50 parts of LBPK, was beaten with a disk refiner to a Canadian freeness of 300 cc, then added with 0.5 parts of epoxylated behenate amide, 1.0 part of anionic polyacrylamide, 1.0 part of aluminum sulfate, 0.1 parts of polyamidepolyamine epichlorohydrin and 0.5 parts of cationic polyacrylamide, all in absolute dry mass ratios to the pulp, and was subjected to a paper making with a long-screen paper mill to form a base paper with a basis weight of 114 g/m$^2$, of which thickness was adjusted to 100 $\mu$m by a calendaring process.

After a corona discharge treatment on both surfaces of the base paper, polyethylene was coated with a fusion extruder so as to obtain a resin thickness of 36 $\mu$m thereby forming a resin layer of a matted surface (this surface being called a rear surface). Then, on a surface opposite to the surface bearing the above-mentioned resin layer, polyethylene containing titanium dioxide of anatase type in 10% and a small amount of Prussian blue was coated with a fusion extruder so as to obtain a resin thickness of 50 $\mu$m thereby forming a resin layer with a glossy surface (this surface being called a front surface). On the polyethylene coated rear surface, after a corona discharge treatment, aluminum oxide (trade name: Alumina Sol 100, manufactured by Nissan Chemical Industries, Inc.)/silicon dioxide (trade name: Snowtex-O, manufactured by Nissan Chemical Industries, Inc.)=½ (mass ratio) were dispersed in water and coated with a dry mass amount of 0.2 g/m$^2$. Then, on the polyethylene coated front surface, after a corona discharge treatment, the above-described undercoating liquid was coated with a coating amount of mica of 0.26 g/m$^2$ to obtain a support with an undercoat layer.

<Coating of Coating Liquid for Each Recording Layer>

On the support with the undercoat layer, seven layers were simultaneously coated in an order from the bottom of the recording layer coating liquid (c), the intermediate layer coating liquid, the recording layer coating liquid (b), the intermediate layer coating liquid, the recording layer coating liquid (a), the coating liquid for the optical transmittance regulating layer, and the coating layer for the protective layer and were dried under a condition of 30° C. and 30% RH and a condition of 40° C. and 30% RH to obtain a thermal recording material.

In this operation, the recording layer coating liquid (a) was coated in such a manner that the diazo compound (A) had a solid coating amount of 0.078 g/m$^2$, the recording layer coating liquid (b) was coated in such a manner that the diazo compound (D) had a solid coating amount of 0.206 g/m$^2$, and the recording layer coating liquid (c) was coated in such a manner that the electron donating dye (H) has a solid coating amount of 0.355 g/m$^2$.

Also, the intermediate layer coating liquid was coated, between (a) and (b), so as to have a solid coating amount of 2.39 g/m$^2$ and, between (b) and (c), so as to have a solid coating amount of 3.34 g/m$^2$, while the coating liquid for the optical transmittance regulating layer was so coated as to have a solid coating amount of 2.35 g/m$^2$, and the coating liquid for the protective layer was so coated as to have a solid coating amount of 1.39 g/m$^2$.

Example 2

A thermal recording material was prepared in a similar manner as in the example 1, except that, in the <preparation of the microcapsule liquid (c) including the electron donating dye precursor> in the "(3) preparation of coating liquid for cyan recording layer", 8.0 parts of the aforementioned compound (1) were replaced by 8.0 parts of a following compound (2).

Example 3

A thermal recording material was prepared in a similar manner as in the example 1, except that, in the <preparation of the microcapsule liquid (c) including the electron donating dye precursor> in the "(3) preparation of coating liquid for cyan recording layer", 8.0 parts of the aforementioned compound (i) were replaced by 8.0 parts of a following compound (3).

Example 4

A thermal recording material was prepared in a similar manner as in the example 1, except that, in the <preparation of the microcapsule liquid (c) including the electron donating dye precursor> in the "(3) preparation of coating liquid for cyan recording layer", 8.0 parts of the aforementioned compound (1) were replaced by 8.0 parts of a following compound (4).

Example 5

A thermal recording material was prepared in a similar manner as in the example 1, except that, in the <preparation of the microcapsule liquid (c) including the electron donating dye precursor> in the "(3) preparation of coating liquid for cyan recording layer", 8.0 parts of the aforementioned compound (1) were replaced by 8.0 parts of a following compound (5).

Example 6

A thermal recording material was prepared in a similar manner as in the example 1, except that, in the <preparation of the microcapsule liquid (c) including the electron donating dye precursor> in the "(3) preparation of coating liquid for cyan recording layer", 8.0 parts of the aforementioned compound (1) were replaced by 8.0 parts of a following compound (6).

Example 7

A thermal recording material was prepared in a similar manner as in the example 1, except that, in the <preparation of the microcapsule liquid (c) including the electron donating dye precursor> in the "(3) preparation of coating liquid for cyan recording layer", 8.0 parts of the aforementioned compound (1) were replaced by 8.0 parts of a following compound (7).

Comparative Example 1

A thermal recording material was prepared in a similar manner as in the example 1, except that, in the <preparation of the microcapsule liquid (c) including the electron donating dye precursor> in the "(3) preparation of coating liquid for cyan recording layer", 8.0 parts of the aforementioned compound (1) trade name: LIGHTESTER TMP, supplied by Kyoueisha Chemical Co., Ltd.) and 8.0 parts of a mixture of 1-methylpropylphenyl-phenylmethane and 1-(1-methylpropylphenyl)-2-phenylethane (trade name: Hisol SAS-310, manufactured by Nippon Petroleum Inc.) were replaced by 16.0 parts of a mixture of 1-methylpropyiphenyl-phenylmethane and 1-(1-methylpropylphenyl)-2-phenylethane (trade name: Hisol SAS-310, manufactured by Nippon Petroleum Inc.).

Compound (2)

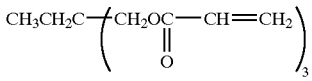

Compound (3)

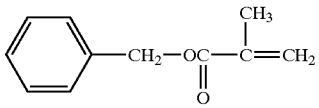

Compound (4)

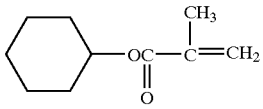

Compound (5)

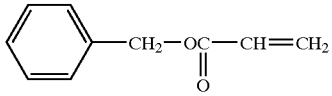

Compound (6)

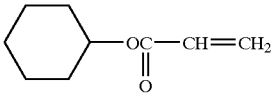

Compound (7)

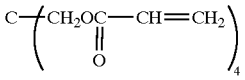

<Performance Evaluation of Thermal Recording Material>

The thermal recording materials of Examples 1 to 7 and Comparative Example 1 were evaluated in a following manner, utilizing a printing apparatus TRT-21 (manufactured by Nagano Nihon Radio Co., Ltd. and an ultraviolet lamp.

(1) Thermal Recording

A yellow image was recorded by regulating an applied electric power and a pulse width so as to obtain a recording energy per unit area within a range of 0 to 71 mJ/mm$^2$.

Then, after the thermal yellow developing layer was fixed by an exposure for 10 seconds under an ultraviolet lamp of a central light emission wavelength of 420 nm and an output power of 40 W, a magenta image was recorded by regulating an applied electric power and a pulse width so as to obtain a recording energy of a thermal head within a range of 0 to 131 mJ/mm$^2$.

Finally, after the thermal magenta developing layer was fixed by an exposure for 15 seconds under an ultraviolet lamp of a central light emission wavelength of 365 nm and an output power of 40 W, a cyan image was recorded by regulating an applied electric power and a pulse width so as to obtain a recording energy of the thermal head within a range of 0 to 171 mJ/mm$^2$.

(2) Measurement of Developed Color Density

On the thermal recording materials subjected to color development in (1), a density of the developed cyan color was measured with MacBeth densitometer RD-918 (manufactured by MacBeth Inc.).

(3) Measurement of Image Retention Rate

The thermal recording materials, subjected to the measurement of the developed cyan density in (2), were irradiated with a light irradiating apparatus Weatherometer C1 65 (manufactured by Atlas Electric Device Inc.) for 6 days and 12 days with a light irradiating power of 390 W/m$^2$, and were then subjected to a measurement of the developed cyan color density as in (2).

An image retention rate was obtained by dividing the developed cyan color density after irradiation for 6 days or 12 days, by the developed cyan color density prior to the irradiation. The obtained image retention rates are shown in Tab. 4.

TABLE 4

| | Ex. 1 | Ex. 2 | Ex. 3 | Ex. 4 | Ex. 5 | Ex. 6 | Ex. 7 | Comp. Ex. 1 |
|---|---|---|---|---|---|---|---|---|
| Non-irradiated | 100 | 100 | 100 | 100 | 100 | 100 | 100 | 100 |
| Irradiated 6 days | 74 | 75 | 68 | 70 | 67 | 69 | 73 | 53 |
| Irradiated 12 days | 60 | 60 | 53 | 55 | 53 | 54 | 60 | 40 |

* Figures in table being in %.

Table 4 indicates that the image retention rate is higher in the thermal recording materials of Examples 1 to 7 than in that of Comparative Example 1.

Therefore, the present invention can provide a thermal recording material of a higher light fastness.

What is claimed is:

1. A thermal recording material comprising a support and at least one recording layer disposed on the support, wherein the recording layer(s) include(s) an electron donating dye precursor and an electron accepting compound and further include(s) a polymerizable compound having an ethylenic unsaturated bond.

2. The thermal recording material according to claim 1, wherein the polymerizable compound having the ethylenic unsaturated bond includes two or more ethylenic unsaturated bonds.

3. The thermal recording material according to claim 1, wherein the polymerizable compound having the ethylenic unsaturated bond includes at least one of compounds represented by Formulas (1) to (7)

(1)

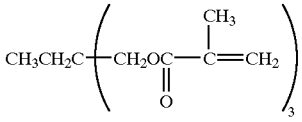

(2)

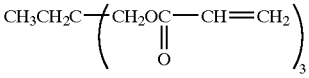

-continued (3)

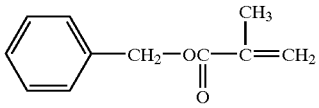

(4)

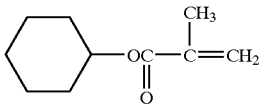

(5)

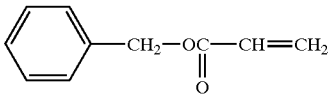

(6)

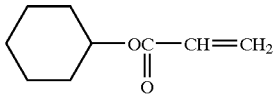

(7)

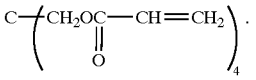

4. The thermal recording material according to claim 3, wherein the polymerizable compound having the ethylenic unsaturated bond includes at least one of compounds represented by the above Formulas (1), (2) and (7).

5. The thermal recording material according to claim 1, wherein the polymebizale compound having the ethylenic unsaturated bond is included in the recording layer in an amount of 25 to 300 parts by mass with respect to 100 parts by mass of the electron donating dye precursor.

6. The thermal recording material according to claim 1, wherein the electron donating dye precursor is included, together with the polymerizable compound having the ethylenic unsaturated bond, in microcapsules.

7. The thermal recording material according to claim 6, wherein a wall membrane of the microcapsules includes at least one compound selected from a group consisting of polyurethane resin, polyurea resin, polyurethane-polyurea resins polyamide resin, polyester resin, polycarbonate resin, aminoaldehyde resin, melamine resin, polystyrene resin, styrene-acrylate copolymer resin, styrene-methacrylate copolymer resin, gelatin, and polyvinyl alcohol.

8. The thermal recording material according to claim 6, wherein the microcapsules have a particle size within a range of 0.05 to 1.0 $\mu$m.

9. The thermal recording material according to claim 1, wherein the electron accepting compound includes at least one selected from a group consisting of bisphenols and hydroxybenzoic acid esters.

10. The thermal recording material according to claim 1, further comprising at least one recording layer including a diazonium salt compound and a coupler capable of color development by reaction with the diazonium salt compound, thereby being capable of forming a multi-color image.

11. The thermal recording material according to claim 10, wherein the diazonium salt compound is included in microcapsules.

12. The thermal recording material according to claim 10, wherein the recording layer including the diazonium salt compound and the coupler capable of color development by reaction with the diazonium salt compound further includes a base substance.

13. The thermal recording material according to claim 12, wherein the base substance includes at least one selected from a group consisting of tertiary amines, piperidines, piperadines, amidines, pyridines, guanidines, and morpholines.

14. The thermal recording material according to claim 1, comprising, on a support, at least a first recording layer including an electron donating dye precursor and an electron accepting compound, a second recording layer including a diazonium salt compound having a maximum absorption wavelength within a range of 365±40 nm and a coupler, capable of color development by reaction under heating with the diazonium salt compound, and a third recording layer including a diazonium salt compound having a maximum absorption wavelength within a range of 425±40 nm and a coupler capable of color development by reaction under heating with the diazonium salt compound.

15. The thermal recording material according to claim 1, further comprising an intermediate layer, a protective layer and an optical transmittance regulating layer.

16. The thermal recording material according to claim 15, wherein the intermediate layer includes a compound selected from the group consisting of gelatin, phthalated gelatin, polyvinyl alcohol, denatured polyvinyl alcohol, polyvinylpyrrolidine, methylcellulose, sodium polystyrenesulfonate, and a styrene-maleic acid copolymer.

17. The thermal recording material according to claim 15, wherein the protective layer includes at least one selected from the group consisting of polyvinyl alcohol, carboxy-denatured polyvinyl alcohol, a vinyl acetate-acrylamide copolymer, silicon-denatured polyvinyl alcohol, starch, denatured starch, methylcellulose, carboxymethylcellulose, hydroxymethylcellulose, a gelatin, gum Arabic, casein, a styrene-maleic acid copolymer hydrolyzate, a styrene-maleic acid copolymer half ester hydrolyzate, an isobutane-maleic anhydride copolymer hydrolyzate, a polyacrylamide derivative, polyvinylpyrrolidone, sodium polystylenesulfonate, sodium alginate, styrene-butadiene rubber latex, acrylonitrile-butadiene rubber latex, methyl acrylate-butadiene rubber latex, and vinyl acetate emulsion.

18. The thermal recording material according to claim 15, wherein a coating amount of the protective layer is within a range of 0.2 to 5 $g/m^2$ in a dry coating amount.

* * * * *